US005697016A

United States Patent [19]

Kitsu et al.

[11] Patent Number: 5,697,016

[45] Date of Patent: Dec. 9, 1997

[54] IMAGE FORMING APPARATUS OPERABLE IN HORIZONTAL AND VERTICAL INSTALLATIONS

[75] Inventors: Kunihiro Kitsu, Inagi; Kaneatsu Uchiyama, Kawasaki; Nobuyuki Tanaka, Kawasaki; Hiroyuki Kawai, Kawasaki, all of Japan

[73] Assignee: Fujitsu Limited, Kanagawa, Japan

[21] Appl. No.: 597,248

[22] Filed: Feb. 6, 1996

Related U.S. Application Data

[62] Division of Ser. No. 291,861, Aug. 17, 1994, Pat. No. 5,512,975.

[30] Foreign Application Priority Data

Nov. 29, 1993 [JP] Japan ..... 5-326045

[51] Int. Cl.[6] ..... G03G 15/20

[52] U.S. Cl. ..... 399/69; 399/108; 399/320

[58] Field of Search ..... 355/282, 285, 355/288, 290, 200; 399/69, 108, 320, 328

[56] References Cited

U.S. PATENT DOCUMENTS

| | | | |
|---|---|---|---|
| 4,248,520 | 2/1981 | Kurita et al. | 355/286 |
| 4,571,056 | 2/1986 | Tani et al. | 355/290 |
| 5,164,778 | 11/1992 | Tanabe et al. | 355/215 |
| 5,325,158 | 6/1994 | Guelfo et al. | 355/215 |
| 5,457,517 | 10/1995 | Katakabe et al. | 355/200 |

FOREIGN PATENT DOCUMENTS

| | | |
|---|---|---|
| 1-105277 | 4/1989 | Japan . |
| 4-323125 | 11/1992 | Japan . |

*Primary Examiner*—Nestor R. Ramirez

*Attorney, Agent, or Firm*—Armstrong, Westerman, Hattori, McLeland & Naughton

[57] ABSTRACT

Disclosed is an image forming apparatus for forming a toner image on a sheet both in a horizonal installation and in a vertical installation of the apparatus. The image forming apparatus is designed so that an air flow from a thermal fixing unit exerts no influence on an image forming operation of a photosensitive body and a temperature detection operation of the thermal fixing unit even when installed horizontally or vertically. This image forming apparatus therefore includes an exhaust duct for guiding a gas of an interior of the thermal fixing unit in an upper oblique direction from the thermal fixing unit to exhaust the interior Of the thermal fixing unit. The air flow from the thermal fixing unit does not therefore influence an image formation on the photosensitive body even when the apparatus is installed horizontally or vertically. This image forming apparatus also includes a temperature detector provided obliquely to a heat roller of the thermal fixing unit. The image forming apparatus further includes a plurality of temperature detectors each provided in a different position with respect to the heat roller of the thermal fixing unit. The image forming apparatus still further includes a temperature detector for detecting a temperature of the heat roller and a control circuit for controlling a fixing temperature of the heat roller by comparing a set temperature corresponding to an installing direction of the apparatus with a temperature detected by the temperature detector. The temperature of the heat roller can be therefore accurately controlled irrespective of the installing direction of the apparatus.

6 Claims, 19 Drawing Sheets

IMAGE FORMING APPARATUS OPERABLE IN HORIZONTAL AND VERTICAL INSTALLATIONS

This is a divisional of application Ser. No. 08/291,861 filed on Aug. 17, 1994 now U.S. Pat. No. 5,512,975.

BACKGROUND OF THE INVENTION

1. Filed of the Invention

The present invention relates to an image forming apparatus capable of operating to form an image both in a horizontal installation and in a vertical installation of the apparatus.

2. Description of the Related Art

In an image forming apparatus such as a copying machine, a printer, a facsimile, etc., a latent image forming apparatus like an electrophotographic apparatus has been utilized from a demand for recording on ordinary paper. In such an image forming apparatus, an electrostatic latent image is formed on a photosensitive drum. Next, the electrostatic latent image on this photosensitive drum is developed with a powder developer and is thereby transformed into a visible image. Further, the powder developer on the photosensitive drum is transferred onto a sheet. This sheet is separated therefrom, and the powder-developed image on the sheet is fixed.

In this type of image forming apparatus, it is desirable to make effective use of an installation space by changing an installation position of the apparatus.

FIG. 23 is a view of assistance in explaining a prior art.

For example, Japanese Patent Laid-Open Publication No.4-323125 discloses an image forming apparatus capable of operating even when the apparatus is installed horizontally or when installed vertically. In this image forming apparatus, the sheet is fed upward in the vertical installation of the apparatus, and, therefore, a fixing unit is positioned above a photosensitive drum. Then, a developing unit is positioned under the photosensitive drum. Accordingly, in the horizontal installation of the apparatus, the developing unit supplies toners in the horizontal direction, and hence the toner supplying direction becomes an antigravity direction when installed vertically.

On the other hand, as illustrated in FIG. 23, a thermal fixing unit 91 includes a heat roller 91-1 and a backup roller 91-2. A frame 91-3 is provided along the periphery of this heat roller 91-1. This frame 91-3 covers the periphery of the heat roller 91-1, thus making an attempt to improve a thermal fixing factor.

In this thermal fixing unit 91, a water vapor is generated by heating up the sheet. This water vapor is diffused together with the heat within the apparatus. As depicted in FIG. 23, some heat and some water vapor run through between sheet guides 92, 93 and the frame 91-3 and are diffused within the apparatus. When this water vapor is stuck to the photosensitive drum 90, an adhesion of the toners is produced, resulting in a deterioration in terms of a printing result. Further, when the heat is given to the photosensitive drum 90, a photosensitive layer of the photosensitive drum 90 is also deteriorated.

Under such circumstances, a known apparatus among the image forming apparatuses installed only in the horizontal position is provided with an exhaust duct (e.g., Japanese Patent Publication No.1-105277)

In this apparatus capable of being installed horizontally and vertically, it is required that a developing agent be fed upward when installed vertically according to a conventional construction in which the developing unit is positioned under the photosensitive drum when installed vertically. For this reason, the developing action is easy to become unstable, and, besides, a large feed mechanism is needed. This construction is therefore unsuitable for a small-sized apparatus.

In contrast with this, it is desirable to take such a placement that the developing unit is positioned above the photosensitive drum when installed vertically. With this placement, however, the fixing unit is disposed under the photosensitive drum, and it follows that the heat and the water vapor in the fixing unit rise directly toward the photosensitive drum. This brings about a decline in terms of an image forming function of the photosensitive drum as well as a deterioration of the photosensitive drum.

Further, as stated above, the direction of a release air flow from the fixing unit varies depending on the horizontal installation and the vertical installation. It is therefore difficult to smoothly control a fixing temperature of the thermal fixing unit.

SUMMARY OF THE INVENTION

It is a primary object of the present invention to provide an image forming apparatus constructed to prevent troubles caused by variations in terms of direction of a release air flow from a fixing unit even when the apparatus is installed horizontally or vertically.

It is another object of the present invention to provide an image forming apparatus constructed to prevent a heat and a water vapor of the thermal fixing unit from running directly to a photosensitive body even when the apparatus is installed horizontally or vertically.

It is still another object of the present invention to provide an image forming apparatus constructed to stably control a fixing temperature irrespective of variations in direction of a thermal air flow from the thermal fixing unit even when the apparatus is installed horizontally or vertically.

To accomplish the above objects, according to one aspect of the present invention, there is provided an image forming apparatus for forming a toner image on a sheet both in a horizonal installation and in a vertical installation of the apparatus, the image forming apparatus comprising: an image forming unit for forming the toner image on a rotary photosensitive body assuming an endless-shape and then transferring the toner image onto the sheet; a thermal fixing unit, positioned under the image forming unit when installed vertically, for thermally fixing the toner image on the sheet fed from above; and an exhaust duct for guiding a gas in an interior of the thermal fixing unit in an oblique upper direction from the thermal fixing unit in order to exhaust the interior of the thermal fixing unit.

According to one aspect of the present invention, there is provided the exhaust duct for guiding the gas of the interior of the thermal fixing unit in the upper oblique direction from the thermal fixing unit. It is therefore possible to exhaust an ascending air flow from within the thermal fixing unit via the exhaust duct even when installed horizontally or vertically. Hence, the heat and the water vapor of the thermal fixing unit can be prevented from running toward the photosensitive body even by taking such an arrangement that the thermal fixing unit is disposed under the image forming unit when installed vertically.

According to another aspect of the present invention, there is provided an image forming apparatus for forming a toner image on a sheet both in a horizonal installation and in a vertical installation of the apparatus, the image forming apparatus comprising: an image forming unit for forming the toner image on a rotary photosensitive body assuming an endless-shape and then transferring the toner image onto the sheet; a thermal fixing unit, having a heat roller and positioned under the image forming unit when installed vertically, for thermally fixing the toner image on the sheet fed from above; and a temperature detector, provided obliquely to the heat roller of the thermal fixing unit, for detecting a temperature of the thermal fixing unit.

According to another aspect of the present invention, the temperature detector is provided obliquely to the heat roller of the thermal fixing unit. Hence, the same temperature detecting conditions are presented for the ascending air flow from within the thermal fixing unit both in the horizontal installation and in the vertical installation. It is therefore feasible to prevent an error in terms of temperature detection between the horizonal installation and the vertical installation, whereby the stable fixing temperature control is attainable.

According to still another aspect of the present invention, there is provided an image forming apparatus for forming a toner image of a sheet both in a horizonal installation and in a vertical installation of the apparatus, the image forming apparatus comprising: an image forming unit for forming the toner image on a rotary photosensitive body assuming an endless-shape and then transferring the toner image onto the sheet; a thermal fixing unit, having a heat roller and positioned under the image forming unit when installed vertically, for thermally fixing the toner image on the sheet fed from above; and a plurality of temperature detectors, each provided in a different position with respect to the heat roller of the thermal fixing unit, for detecting a temperature of the thermal fixing unit.

According to still another aspect of the present invention, the plurality of temperature detectors are provided in different positions with respect to the heat roller of the thermal fixing unit. It is therefore possible to select the temperature detector corresponding to the horizontal or vertical installation and take an average of outputs of the two temperature detectors. This in turn makes it possible to prevent the error of the temperature detection between the horizontal installation and the vertical installation, with the result that the stable fixing temperature control is attainable.

According to a further aspect of the present invention, there is provided an image forming apparatus for forming a toner image on a sheet both in a horizonal installation and in a vertical installation of the apparatus, the image forming apparatus comprising: an image forming unit for forming the toner image on a rotary photosensitive body assuming an endless-shape and then transferring the toner image onto the sheet; a thermal fixing unit, having a heat roller and positioned under the image forming unit when installed vertically, for thermally fixing the toner image on the sheet fed from above; a temperature detector for detecting a temperature of the heat roller of the thermal fixing unit; and a control circuit for controlling a fixing temperature of the heat roller, by comparing a set temperature corresponding to an installing direction of the apparatus with a temperature detected by the temperature detector.

According to a further aspect of the present invention, the fixing temperature of the heat roller is controlled by comparing the set temperature corresponding to the installing direction with the detected temperature of the temperature detector. Therefore, the temperature control error between the horizonal installation and the vertical installation can be prevented, and the stable fixing temperature control is attainable.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principle of the invention, in which.

DETAILED DESCRIPTION OF THE PREFERRED EMBODIMENTS

Figure 1:
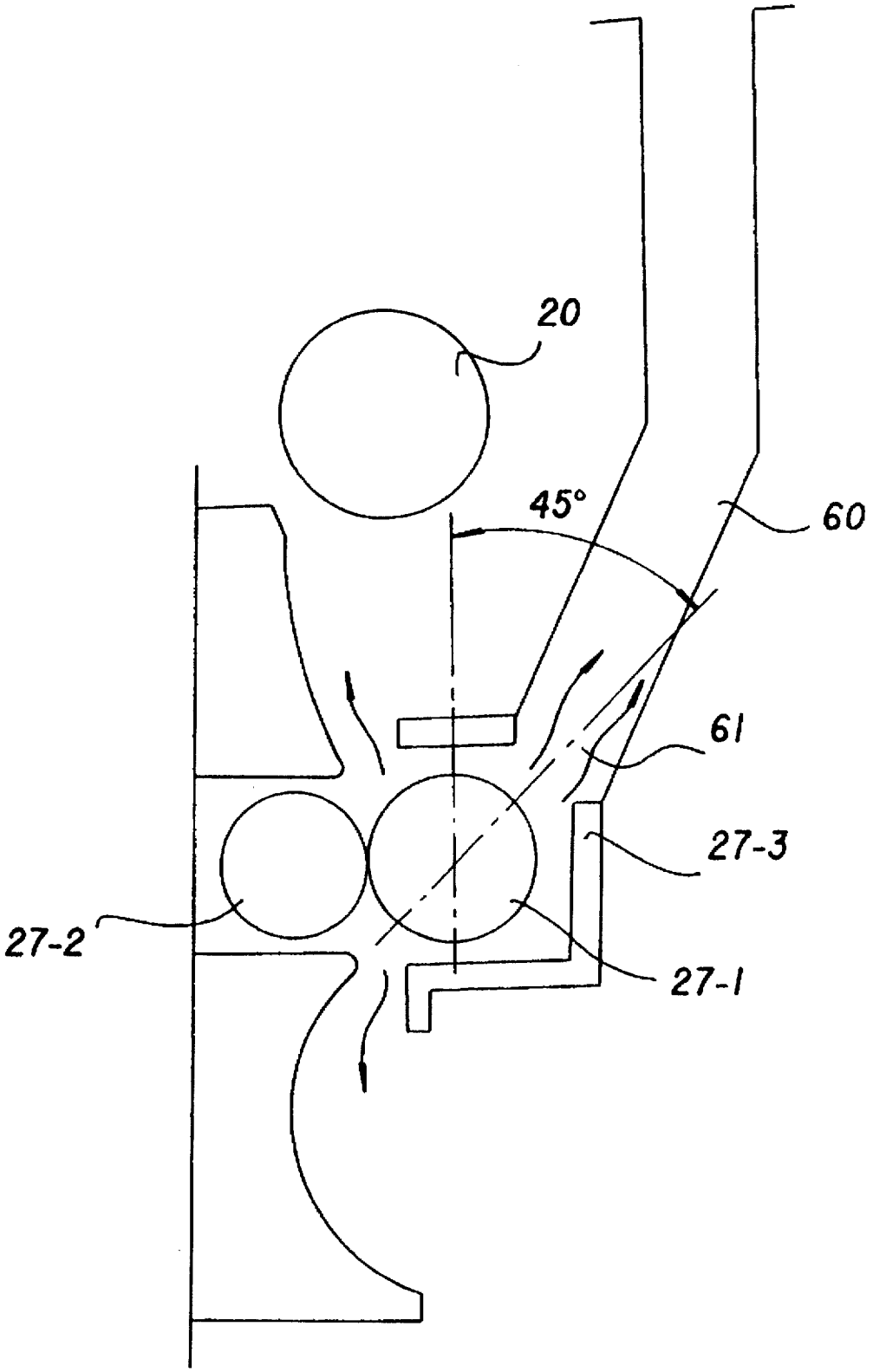
FIG. 1 is a view showing a principle of the present invention.

FIG. 1 is a view illustrating a principle of the present invention.

As illustrated in FIG. 1, a thermal fixing unit 27 includes a heat roller 27-1, a backup roller 27-2 and a frame 27-3 for covering the heat roller 27-1. Then, in a state where an apparatus shown in FIG. 1 is vertically installed, the thermal fixing unit 27 is positioned under a photosensitive drum 20.

An air outlet 61 of an exhaust duct 60 is provided in an obliquely upper position of the frame 27-3 of this thermal fixing unit 27. In this embodiment, the air outlet 61 is provided in a position of 45° inclined to the frame 27-3. Further, the exhaust duct 60 is formed with a passageway extending obliquely upwards.

With this construction, in the vertical installation state shown in FIG. 1, an ascending air flow from the heat roller 27 is smoothly led to the exhaust duct 60 and then exhausted. Similarly, in the horizontal installation state also, the ascending air flow from the heat roller 27-2 is smoothly led to the exhaust duct 60 and the exhausted.

For this reason, even when the apparatus is installed horizontally or vertically, the ascending air flow from the heat roller 27-2 is prevented from running toward the photosensitive drum 20. Hence, it is possible to prevent an adhesion of a toner image onto the photosensitive drum 20 and also a deterioration a photosensitive layer of the photosensitive drum 20.

Figure 2:
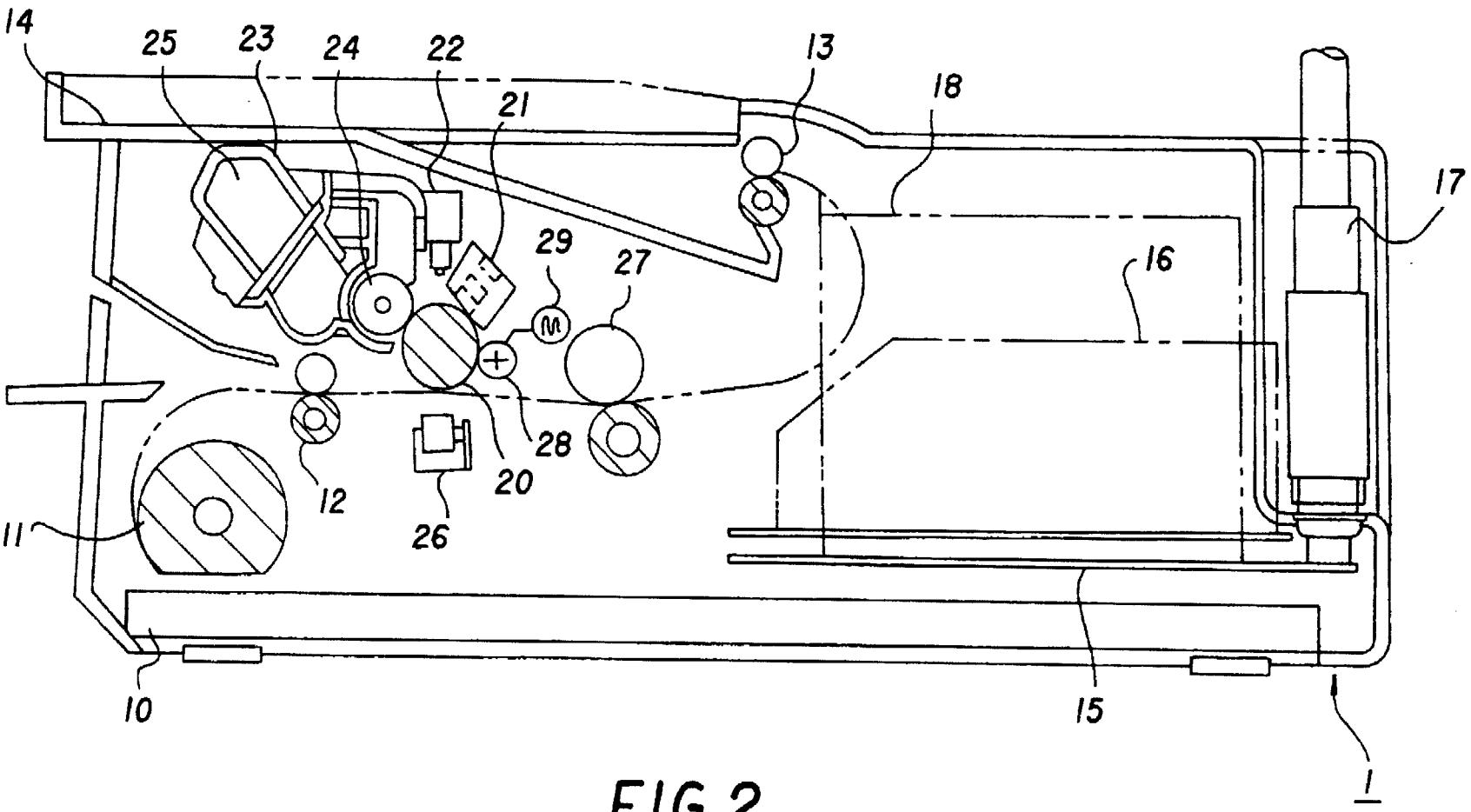
FIG. 2 is a view illustrating a construction of an image forming apparatus in one embodiment of the present invention.
Figure 3:
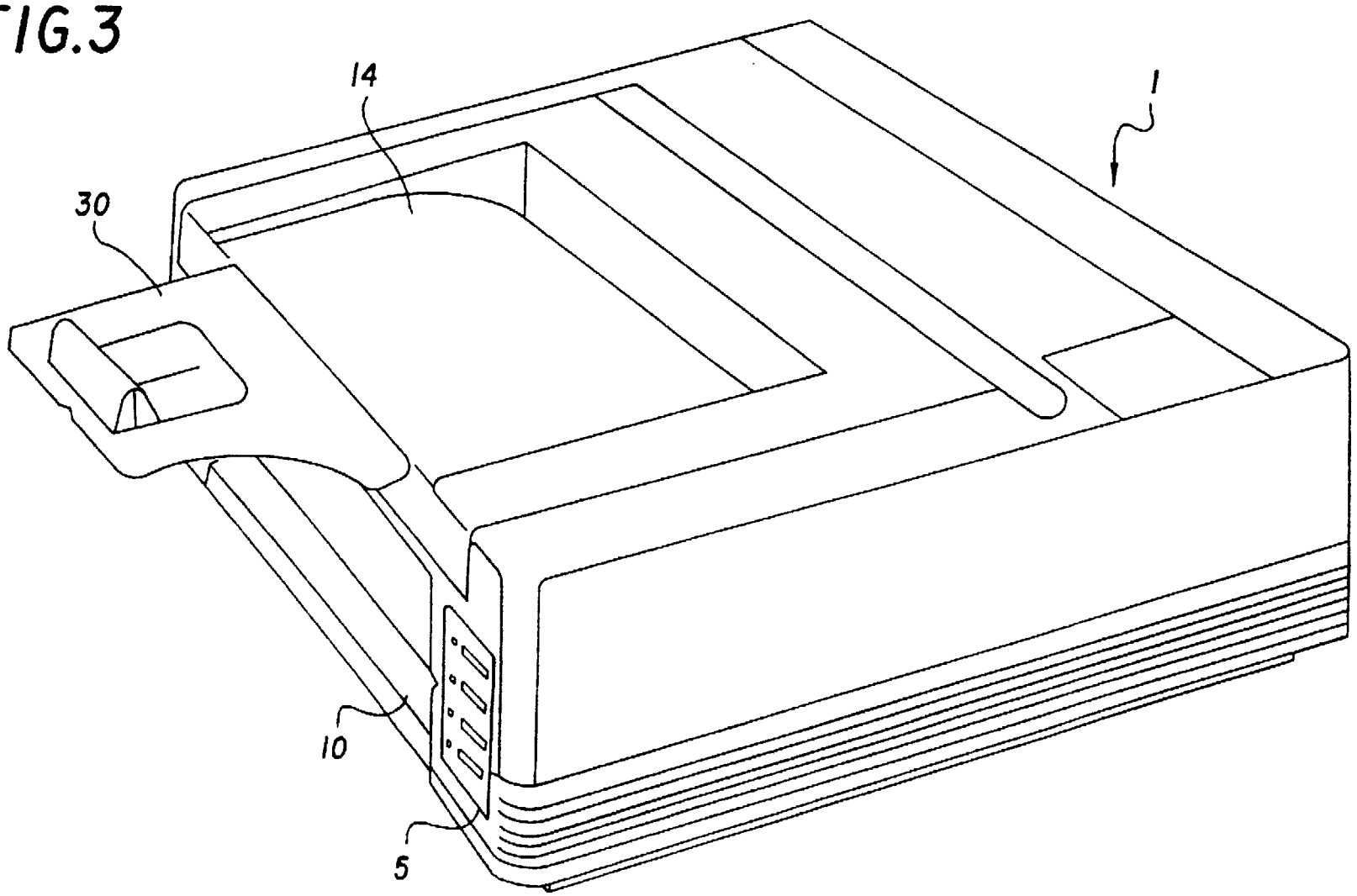
FIG. 3 is a view showing a state of horizontal installation of the apparatus of FIG. 2.
Figure 4:
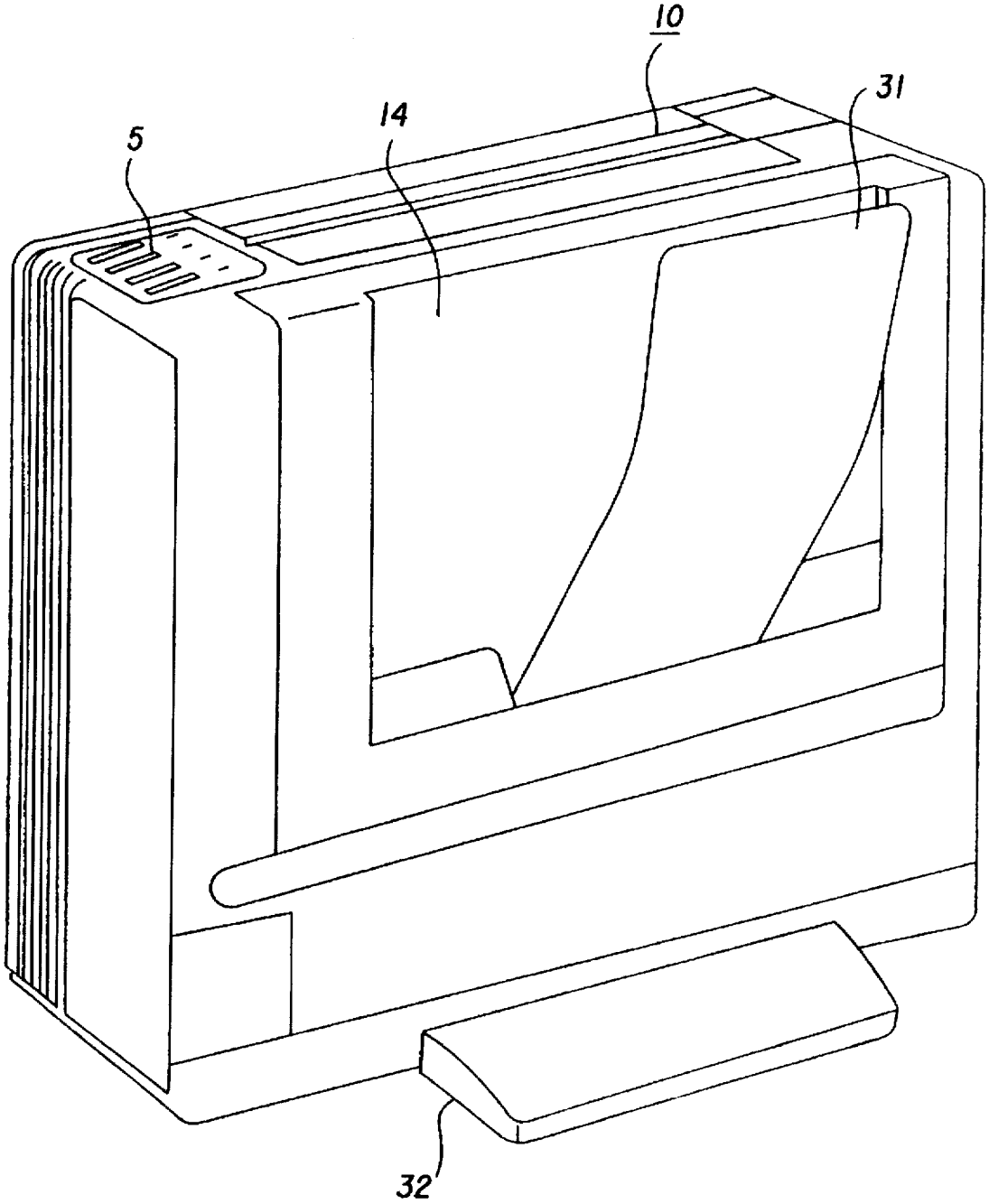
FIG. 4 is a view showing a state of vertical installation of the apparatus of FIG. 2.

FIG. 2 is a view illustrating a construction of an image forming apparatus in one embodiment of the present invention. FIG. 3 is a view showing a state where the apparatus of FIG. 2 is horizontally installed. FIG. 4 is a view showing a state where the apparatus of FIG. 2 is vertically installed.

As illustrated in FIG. 2, the photosensitive drum 20 is constructed such that a functional separation type organic photosensitive body is coated about 20 microns thick on an aluminum drum. A major diameter of the photosensitive drum is 24 mm. The photosensitive drum 20 rotates counterclockwise at a peripheral speed of 25 mm/s. A precharger 21 is a non-contact type charger constructed of a Scorotron. Then, the precharger 21 uniformly charges the surface of the photosensitive drum 20. The precharger 21 charges the surface of the photosensitive drum 20 with −580 V.

An optical unit (photo image exposing unit) 22 performs an image-exposure on the uniformly charged photosensitive drum 20, thereby forming an electrostatic latent image on the photosensitive drum 20. This optical unit 22 involves the use of an LED optical system composed of a combination of an LED array and a self-focus lens array. The image-exposure by this optical unit 22 serves to form the electrostatic latent image of −50 to −100 V on the photosensitive drum 20.

A developing unit 23 supplies charged toners to the electrostatic latent image on the photosensitive drum 20 and transforms it into a visible image as will hereinbelow be stated in FIG. 5. A developing roller 24 of the developing unit 23 feeds a developer to the photosensitive drum 20. A toner cartridge 25 of the developing unit 23 is filled with magnetic toners. This toner cartridge 25 is exchangeably attached to the developing unit 23. The toner cartridge 25 is replaced when in a state of toner empty to supply the developing unit 23 with the magnetic toners.

A transfer unit 26 is constructed of a corona discharger. This transfer unit 26 electrostatically transfers the toner image formed on the photosensitive drum 20 onto a sheet. More specifically, a voltage on the order of +3 kV to +6 kV is applied to a corona wire from a power source, thereby generating an electric charge through the corona discharging. A rear surface of the sheet is thus electrified to transfer the toner image on the photosensitive drum 20 onto the sheet P. This power supply is desirably a constant-current power supply capable of reducing a drop of a transfer efficiency depending on environments by supplying the sheet with a fixed amount of electric charges.

A thermal fixing unit 27 is constructed of a heat roller 27-1 incorporating a halogen lamp serving as a heating source and a pressurizing roller (a back-up roller) 27-2. Then, the sheet is heated up, thereby fixing the toner image onto the sheet.

A dispersion member 28 is constructed of a conductive roller. This dispersion member 28 contacts the photosensitive drum 20 and thereby decentralizes the toners left on the photosensitive drum 20. With this dispersion, the residual toners of the developing unit 23 can be easily collected. Further, an AC voltage 29 is applied to this dispersion member 28, thereby removing the residual toners off the photosensitive drum 20. Besides, reciprocative motions to return them once again are thereby produced. With this operation, the residual toners can be properly dispersed. Moreover, the photosensitive drum 20 is de-electrified by applying a voltage larger than a, start-of-discharging voltage. A positive after-image due to the residual electric charges is eliminated.

As illustrated in FIG 2, a sheet cassette 10 for housing the sheets is detachably attached to the apparatus. This sheet cassette 10 is provided in a lower portion of the apparatus. The sheet cassette 10 can be attached to and detached from the front surface of the apparatus on the left side of the Figure. A pick roller 11 serves to pick the sheet in the sheet cassette 10. A resist roller 12 receives an impingement of the picked sheets, thus aligning the leading edges of the sheets and, thereafter, feeds the sheets to the transfer unit 26. A sheet discharge roller 13 works to discharge the sheet after being fixed to a stacker 14. The stacker 14 mounted on the upper surface of the apparatus stacks the sheets discharged.

A printed circuit board 15 is mounted with a control circuit of the apparatus. A power supply 16 supplies each element of the apparatus with the electric power. An I/F (interface) connector 17 connected to an external cable is inserted into the apparatus and connected to a connector of the printed circuit board 15. An option board 18 is mounted with a different type of emulator circuit, a font memory, etc..

The operation of this embodiment will be explained. A Scorotron charger 21 uniformly charges the surface of the photosensitive drum 20 with −580 V. Thereafter, an image-exposure is effected by an LED optical system 22. With this processing, the photosensitive drum 20 is formed with an electrostatic latent image with a background portion of −580 V and a printing portion of −50 V to −100 V. A developing bias voltage (−450 V) is applied to a sleeve 241 (which will hereinbelow mentioned in FIG. 5) of the developing roller 24 of the developing unit 23. As a result of this, the electrostatic latent image on the photosensitive drum 20 is developed by the developing unit 23 with magnetic polymerized toners which are minus-charged beforehand by stirring with carriers. The electrostatic latent image thus turns out a toner image.

On the other hand, the sheet is picked by the pick roller 11 out of the sheet cassette 10. The leading edges of the sheets are aligned by the resist roller 12. Thereafter, the sheets are fed toward the transfer unit 26. Then, the toner image on the photosensitive drum 20 is transferred onto the sheet by the transfer unit 26 with the electrostatic force. This toner image on the sheet is fixed thereto by the thermal fixing unit 27. The sheet passes through a U-shaped feeding path and is discharged to the stacker 14 by the sheet discharge roller 13.

On the other hand, a transfer rate of the toner image onto the sheet is not 100% but some toners remain on the photosensitive drum 20. A method of removing the residual toners involves the use of a known cleanerless process in which a cleaner is eliminated (e.g., [The Cleanerless Laser Printer Using One-Component Non-Magnetic Phenomenon System] or the like, reported on pp.293–301, 3rd Issue, Vol.30 in the Article Collection compiled by The Association of Electrophotography).

In this cleanerless process, the cleaner is eliminated, and the untransferred residual toners are collected by the developing unit 23. Thus, the untransferred residual toners are reused for printing. In the cleanerless process, the cleaner is eliminated, and, instead, the conductive dispersion member 28 is provided. In this recording process, the dispersion member 28 disperses the untransferred residual toners on the photosensitive drum 20. Subsequently, thereafter, the corona charger 21 effects uniform charging in a state where the toners are adhered onto the photosensitive drum 20. The optical unit 22 performs the image-exposure, and the developing unit 23 conducts the development simultaneously with the collection of the untransferred residual toners.

This dispersion member 28 disperses the toners concentrated on a local area. With this dispersion, a toner quantity per unit area is reduced, thereby making easier the collection by the developing unit 23. Further, the residual toners turn out to be a filter of ion shower of the corona charger 21. This toner dispersion effect restrains a phenomenon of being the filter thereof as well as preventing the charging from being nonuniform. Besides, the residual toners are prevented from being the filter in the image exposure process. This provides an effect of restraining the exposure from being nonuniform.

A point of this recording process is that the toners on the photosensitive drum 20 are collected simultaneously with the developing process. This will be exemplified by such a manner that both of the photosensitive drum 20 and the toners undergo minus-charging. An electric potential on the surface of the photosensitive drum 20 is set to −580 V by the charger. 21. An exposure portion where the electric potential is decreased due to the image exposure forms an electrostatic latent image with a drop of the electric potential down to 0 V ~—several 10 V. A developing bias voltage (e.g., −450 V) which is substantially intermediate between the surface potential and the latent image potential is applied to the developing roller 24 of the developing unit 23 during the developing process.

In the developing process, the minus-charged toners adhered onto the developing roller 24 are stuck to the electrostatic latent image on the photosensitive drum 20 by dint of an electric field formed by the developing bias and the latent image potential, thereby forming the toner image. In the cleanerless process, simultaneously with this developing process, the untransferred residual toners dispersed on the photosensitive drum 20 in the uniformizing process by the dispersion brush 28 are collected by the developing roller 24 from on the photosensitive drum 20 with the electric field formed by the surface potential of the photosensitive drum 20 and the developing bias.

This cleanerless process has the following advantages: (1) the necessity for a mechanism for disposing of toners is eliminated, resulting in the down-sizing of the apparatus; (2) a space for storing the disposal toners is not required; (3) the toners contributing to printing disappear, and, this is therefore economical; (4) the toners are not disposed of, and hence this conforms to the protection of the environment; and (5) removing the toners from the photosensitive drum with the cleanser involves omitting the photosensitive drum with the cleaner, however, a life-span of the photosensitive drum increases because of using no cleaner.

The remarkable down-sizing of this apparatus can be attained for the reason of employing no cleaner and so on. The apparatus is also easy for installation on the disk in the form of a printer for personal use. As illustrated in FIG. 3, the sheet cassette 10 can be placed horizontally to the installation surface. Referring again to FIG. 3, an operation panel 5 displays a state of the apparatus and is, at the same time, intended to indicate an operation to the apparatus. A sheet guide 30 is provided at a front edge of the stacker 14. This sheet guide 30 holds the leading edges of the sheets discharged to the stacker 14 and exhibits an effect of aligning the leading edges thereof. In accordance with this embodiment, the sheet cassette 10 can be attached to and detached from the front surface of the apparatus. Further, the discharge sheets are also discharged from the front surface of the apparatus.

Moreover, as depicted in FIG. 4, the image can be formed with the vertical installation in which the I/F connector 17 (the thermal fixing unit 27) of the apparatus of FIG. 2 is provided on the installation surface, and the sheet cassette 10 is set perpendicular to the installation surface. This installation makes the installation area smaller than before.

At this time, a sheet holder 31 for holding the sheets discharged to the stacker 14 to prevent the sheets from falling down. The sheets can be thereby prevented from falling down even when placed vertically. Further, a stand 32 is provided on the side of the installation surface of the apparatus, with the result that the apparatus can be stably placed even with the vertical installation.

In addition, even when adopting the cleanerless process, the precharger 21 and the transfer unit 26 are constructed of the non-contact type dischargers, and, therefore, the toners on the photosensitive drum 20 are not adhered to these units. Consequently, the uniform charging and transferring can be stably executed.

Figure 5:
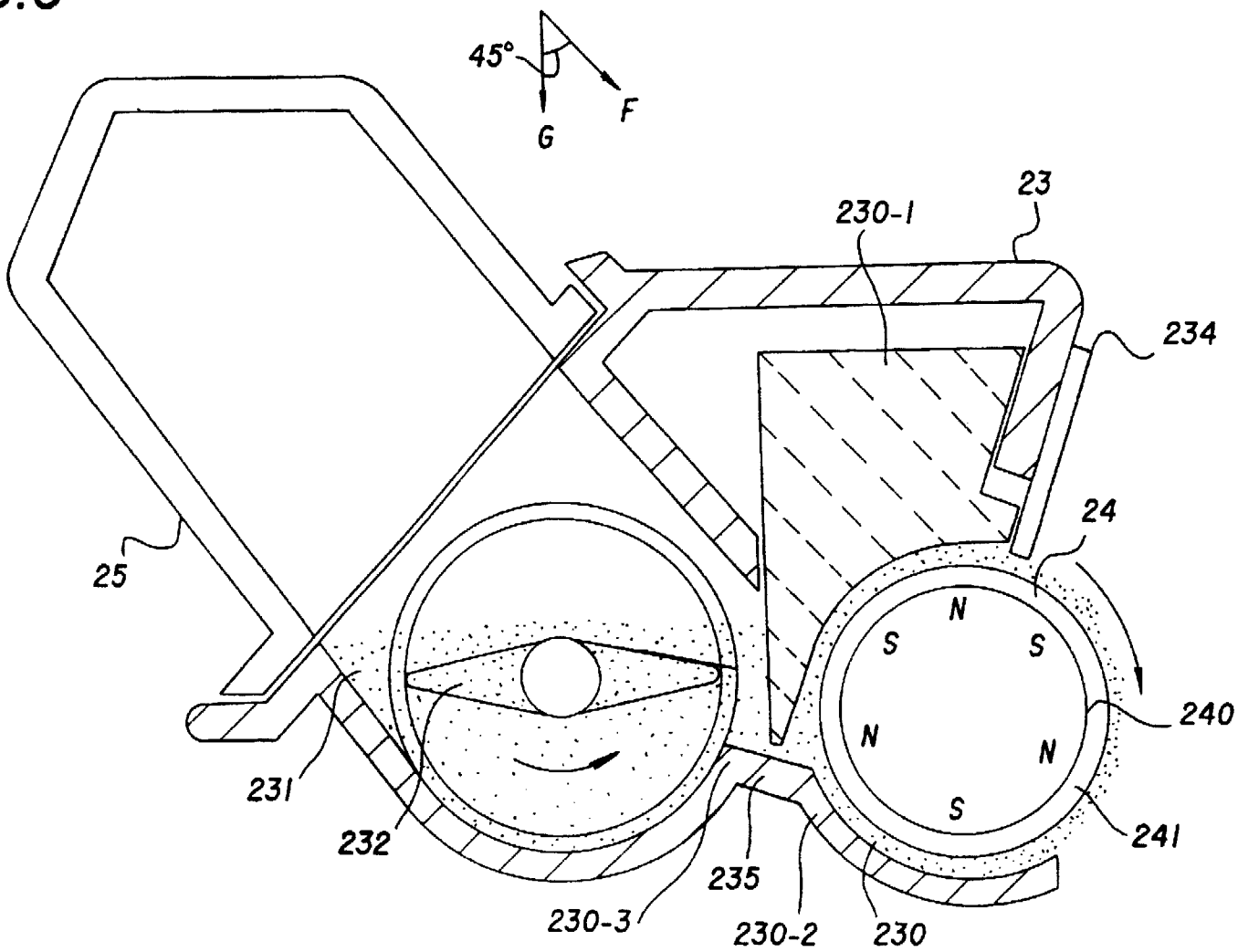
FIG. 5 is a view illustrating a configuration of a developing unit of FIG. 2.
Figure 6:
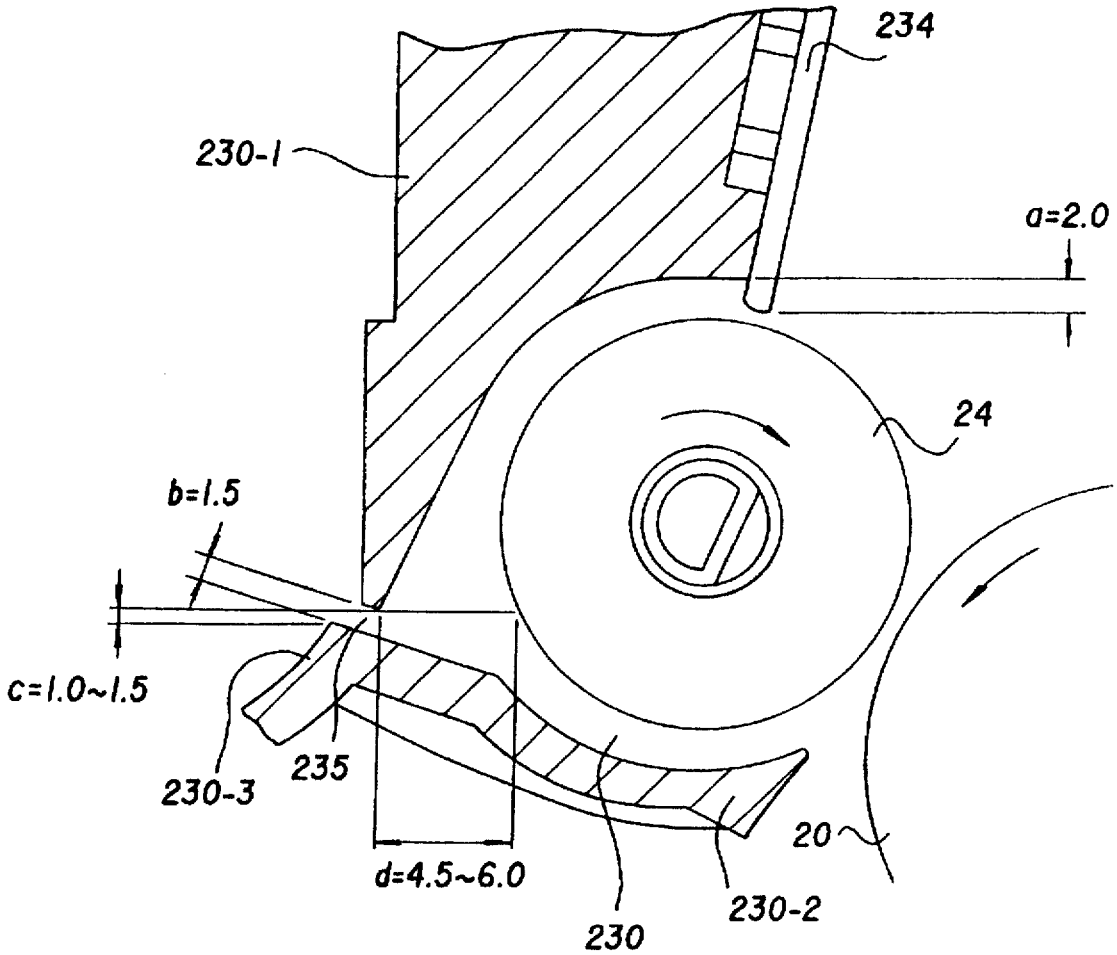
FIG. 6 is a sectional view showing the principal elements of the developing unit of FIG. 5.
Figure 7:
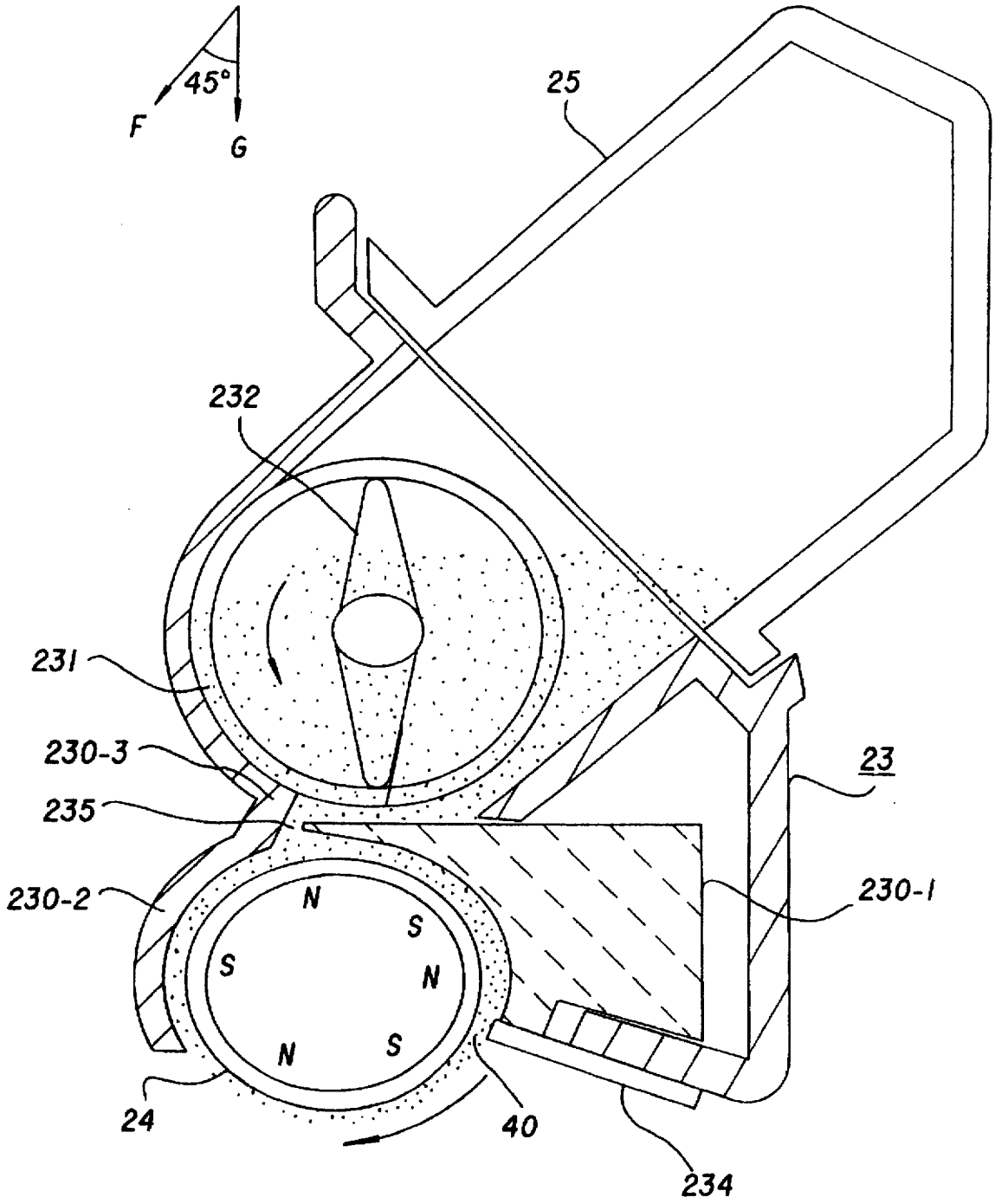
FIG. 7 is a view showing a state of vertical installation of the developing unit of FIG. 2.
Figure 8A:
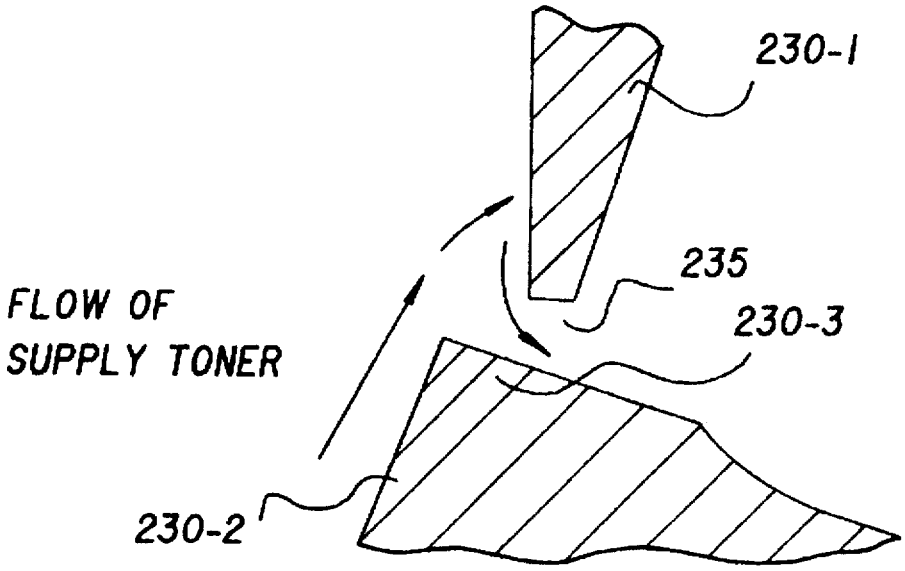
FIG. 8A is a view of assistance in explaining the operation in the horizontal installation of the developing unit of FIG. 5.
Figure 8B:
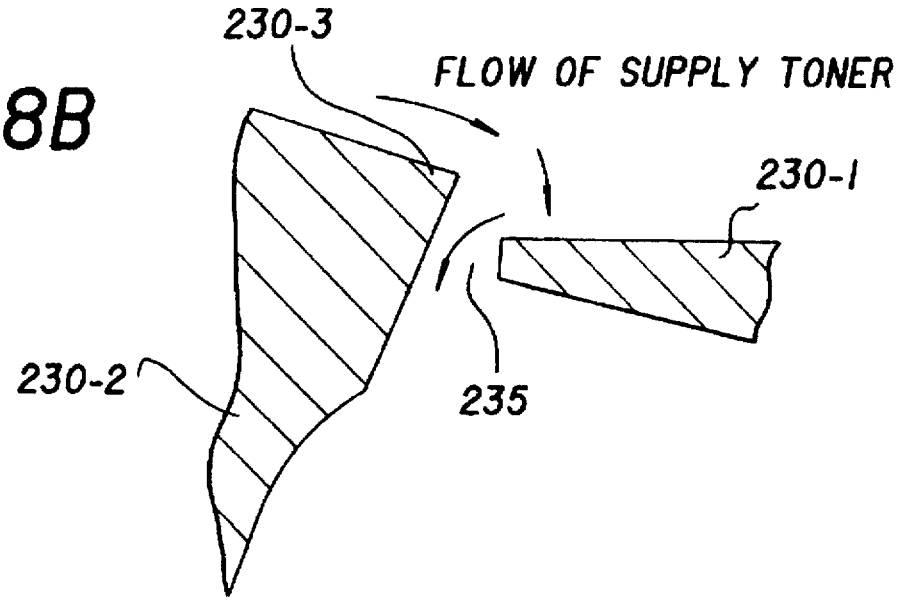
FIG. 8B is a view of assistance in explaining the operation in the vertical installation of the developing unit of FIG. 7.
Figure 9:
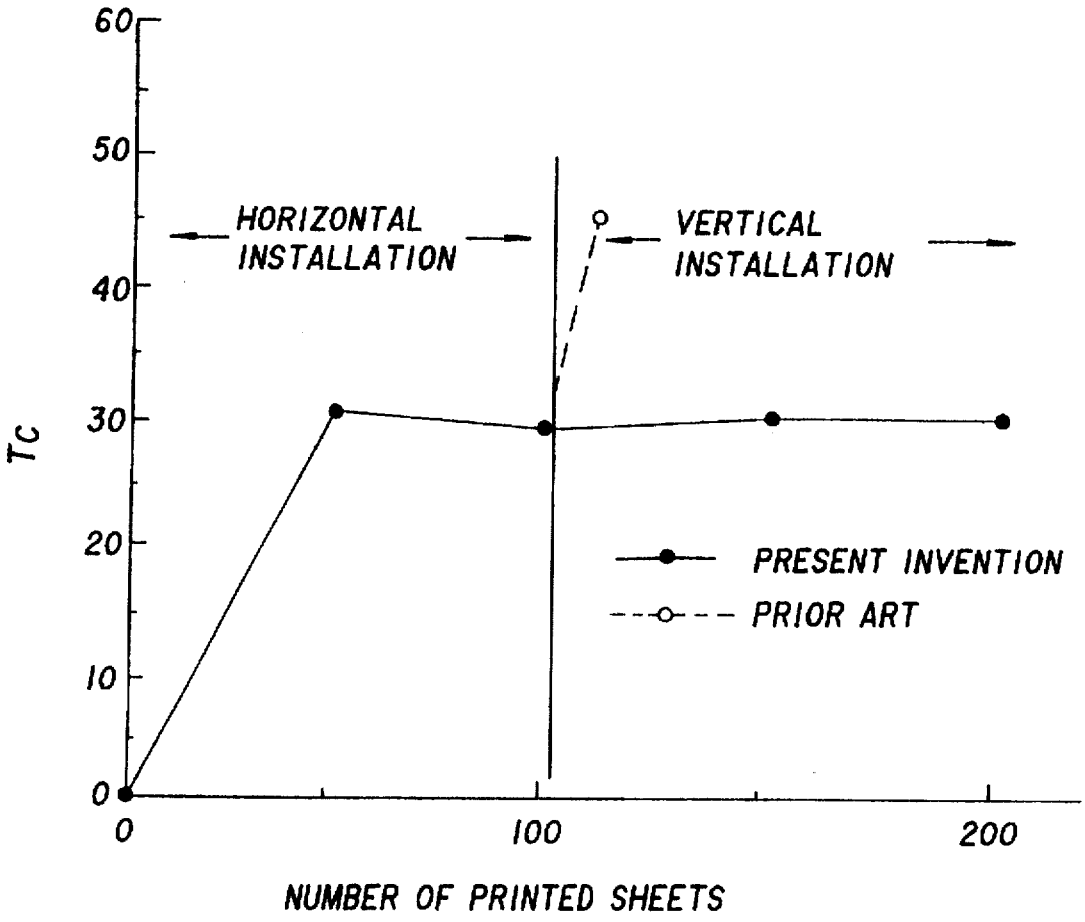
FIG. 9 is a characteristic diagram of a developing operation according to the present invention.

FIG. 5 is a view illustrating a configuration of the developing unit of FIG. 2. FIG. 6 is a sectional view showing the principal elements of the developing unit of FIG. 5. FIG. 7 Is a view showing a state of the vertical installation of the developing unit of FIG. 5. FIGS. 8A and 8B are views of assistance in explaining a toner supplying action. FIG. 9 is a characteristic diagram according to this invention.

As illustrated in FIG. 5, the developing roller 24 comprises a metallic sleeve 241 and a magnet 240 having plurality of magnetic poles and incorporated in the interior thereof. This developing roller 24, in which the magnet 240 in the sleeve 241 is fixed, serves to feed a magnetic developer, which will be mentioned later, with rotations of the sleeve 241. The developing roller 24 is 16 mm in diameter and rotates three times (75 mm/s) as fast as the peripheral speed of the photosensitive drum 20.

A developing chamber 230 is formed along the periphery of the developing roller 24. An interior of the developing chamber 230 is full of a 1.5-component developer as a mixture of the magnetic carriers and the magnetic toners. This developing chamber 230 is defined by an upper partition member 230-1 and a lower bottom 230-2 to have a fixed capacity.

With this arrangement, when a fixed amount of magnetic carriers are put into the developing chamber 230, a quantity of the magnetic toners within the developing chamber 230 becomes fixed. A quantity of the developer in this developing chamber 230 is fixed, and, therefore, a toner density becomes fixed when supplying the consumed magnetic toners from a toner hopper 231. Accordingly, the necessity for controlling the toner density can be eliminated. More specifically, the developing chamber is filled with the carriers having a quantity corresponding to a control point of the toner density, whereby the toner density is automatically controlled in a predetermined range.

Further, the circumferential area along the developing roller 24 is always full of the developer in this developing chamber 230. Hence, even when the apparatus is vertically placed, it is possible to prevent such a situation that the developer in the developing chamber 230 concentrates on one side enough not to supply the developer to the developing roller.

The magnetic carriers of the developer involve the use of magnetite carriers each having an average particle size on the order of 35 microns, while the magnetic toners involve the use of magnetic toners manufactured by use of the polymerization method but each having an average particle size of 7 microns. The polymerized toners are uniform in terms of particle size and sharp in particle size distribution. Therefore, an adhesion of the toner image on the photosensitive drum 20 to the sheet becomes uniform in the transfer process. For this reason, the electric field in the transfer unit also becomes uniform, and, hence, the transfer efficiency can be more enhanced than the toners based on the conventional pulverization method. The pulverized toners have a transfer efficiency of 60–90%, while the polymerized toners exhibit a transfer efficiency improved up to 90% or larger. The toner density is properly 5 wt %–60 wt %. In this embodiment, however, the toner density is set to 30 wt %.

A doctor blade 234 works to adjust the developer quantity supplied by the developing roller 24 to the photosensitive drum 20 so that the developer is not excessively supplied to the electrostatic latent image on the photosensitive drum 20 but does not reversely become short of supply. The adjustment is made with a gap between the edge of the doctor blade 234 and the surface of the developing roller 24. Normally, the gap is adjusted to approximately 0.1–1.0 mm.

The toner hopper 231 is filled with only the magnetic toners and incorporates a supply roller 232. Rotations of this supply roller 232 act to supply the toners to the developing chamber 230.

The toners supplied to the interior of this developing chamber 230 are stirred in the developing chamber 230 by dint of a developer feeding force of the sleeve of the developing roller 24, a magnetic force of the developing roller 24 and a developer regulating function of the doctor blade 234. Then, the toners rub against the carriers to be thereby charged to a predetermined polarity with a charging quantity. In accordance with this embodiment, a charging system between the carriers and the toners is adjusted with the result that the minus-charging takes place.

Further, as illustrated in FIG. 6, a spacing between the partition member 230-1 and the developing roller 24 is set smaller than a height of bristle of the magnetic brush formed above the developing roller 24 by use of the partition member 230-1 on the upstream side of the blade 234. Herein, as illustrated in FIG. 6, a spacing a is set to 2.0 mm. With this setting, the magnetic brush above the developing roller 24 is regulated by the partition member 230-1 and receives a force given by the rotations of the developing roller 24. A stirrability of the developer within the developing chamber 230 is thereby enhanced, and a stable toner charging quantity is obtained in a wide range of the toner density.

Further, this spacing is fixed along the periphery of the developing roller 24, with the result that the charging effect does not vary even when installed horizontally or vertically.

A toner supply passage 235 is defined by the top end of the above partition member 230-1 and the bottom 230-2 between the toner hopper 231 and the developing chamber 30. A width b of this toner supply passage 235 is, as shown in FIG. 6, 1.5 mm. The toners in the toner hopper 231 are fed via this toner supply passage 235 to the developing chamber 230.

The bottom 230-2 shaping this; developing chamber 230 is provided with a protruded member 230-3 protruded into the toner hopper 231 in a position of the toner supply passage 235. Further, this bottom 230-2 is formed with an inclined surface extending upward from the side of the photosensitive drum 20. A spacing between the edge of this protruded member 230-3 and the edge of the partition member 230-2 is, as shown in FIG. 6, set such as c=1.0–1.5 mm. Namely, an inclination is given by this quantity. Further, a distance d between the edge of the partition member 230-1 and the developing roller 24 is set to 4.5–6.0 mm.

As illustrated in FIG. 5, an angle F made by two walls of this toner cartridge 25 and of the toner hopper 231 is set at approximately 45 degrees with respect to a direction-of-gravity G, and a direction of flow of the toners is set at 45 degrees. With this setting, the toners can be smoothly supplied even when the apparatus is placed vertically.

Next, the operation of this developing unit will be explained. FIG. 5 illustrates a state of the developing unit when the apparatus shown in FIG. 3 is horizontally installed. The angle F made by the wall surfaces of the toner cartridge 25 and of the toner hopper 231 is set at about 45 degrees with respect to the direction-of-gravity G. Accordingly, the toners flow toward the bottom of the toner hopper 231 and are smoothly supplied to the supply roller 232.

In this horizontal installation, the toners have a fluidity toward the bottom in the toner hopper 231 because of the gravity. The supply roller 232 therefore scrapes up the toners on the bottom-side of the toner hopper 231. At this time, as illustrated in FIG. 8A, the toners pushed up the supply roller 232 once impinge on the partition member 230-1 because of the protruded member 230-3 of the bottom 230-2. The toners thereafter enter the toner supply passage 235.

With this arrangement, only the toners supplied by the toner supply roller 232 enter the toner supply passage 235. Accordingly, the relevant portion of the partition member 230-1 serves as a buffer. Consequently, an intruding force by the toner supply roller 232 does not exert a direct influence on the toner supply passage 235. Hence, an excessive intrusion of the toners can be prevented, with the result that there are replenished the toners corresponding to an amount of shortage caused in the developing chamber 230.

In this case, the bottom 230-2 is inclined upward to the rotating direction of the developing roller 24. Therefore, the magnetic brush of the developing roller 24 and the carriers existing off this magnetic brush after passing through the photosensitive drum 20 do not leak into the toner supply chamber 231 from the toner supply passage 235 via the bottom 230-2. A reduction in the starter carriers in the developing chamber 230 can be thereby prevented. A stable 1.5-component phenomenon is attainable.

On the other hand, even in the state, illustrated in FIG. 7, of the developing unit when the apparatus shown in FIG. 4, the angle F made by the wall surfaces of the toner cartridge 25 and of the toner hopper 231 is set at about 45 degrees with respect to the direction-of-gravity G. Accordingly, even when installed vertically, the toners can be smoothly supplied to the supply roller 231.

At this time, as illustrated in FIG. 7, the toners stay about the partition member 230-1 on the side of the toner hopper 231 and are therefore easy to fall down into the developing chamber 230 from the toner supply passage 235. As shown in FIG. 8B, however, the protruded member 230-3 of the bottom 230-2 regulates the fall-down of the toners from the toner supply passage 235, and, therefore, almost no fall-down of the toners can be seen. Accordingly, it follows that the toners are supplied by the rotating force of the toner supply roller 232.

That is, as depicted in FIG. 8B, the toners pushed by the supply roller 232 once impinge on the partition member 230-1 because of the protruded member 230-3 of the bottom 230-2 and thus enter the toner supply passage 235. Consequently, only the toners supplied by the toner supply roller 232 enter the toner supply passage 235. Therefore, the relevant portion of the partition member 230-1 serves as the buffer. With this action, the intruding force given by the toner supply roller 232 does not directly turn out to be a toner supplying force. Accordingly, an excessive intrusion of the toners can be prevented. Only the toners corresponding to a quantity of shortage caused in the developing chamber 230 are replenished.

This implies no variation in terms of capability to supply the toners to the developing chamber even when the apparatus is horizontally installed or when installed vertically. It is therefore feasible to prevent variations in the image density because of no change in the toner density in the developing chamber even when the apparatus is horizontally placed or when vertically placed.

That is, the great majority of toners supplied to the developing chamber 230 are based on the toner supply roller 232. It is possible to attain the toner supply that is not influenced by the fluidity acting in the direction of gravity of the toners. For this reason, even if the installing direction of the apparatus changes, the toner supply quantity does not vary, and hence the stable developing operation can be done.

Further, when placed vertically, there exists a possibility of causing the fall-down, of the developer from the developing unit 23. However, the developer involves the use of the magnetic two-component developer and is therefore retained on the developing roller 24 by the magnetic force. As a result, almost no fall-down of the developer takes place even when installing the apparatus vertically. Especially when using the magnetic carriers and the magnetic toners, both of the carriers and the toners are held on the magnet roller of the developing roller 24. Therefore, the fall-down of the developer can be prevented all the more, and the stable developing can be attained in the case of the above-mentioned vertical installation.

FIG. 9 is a characteristic diagram showing variations in toner density Tc when the printing is effected with the apparatus being installed longitudinally (vertically) after conducting the printing with the apparatus being installed laterally (horizontally).

To start with, the apparatus is placed horizontally. Then, a predetermined amount of starter carriers are put into the developing chamber 230 of the developing unit 23. The developing unit is then operated to effect the printing. As a result, the toners are gradually supplied to the developing chamber 230 from the toner hopper 231. The toner density therefore increases with an increment in the number of printed sheets. Subsequently, at the point of time when the developing chamber 230 is full of the carriers and the toners, the toner density becomes 30 wt %. Thereafter, no change can be seen in the toner density even when the number of the printed sheets increases.

Next, in this state, the printing is carried out by changing the apparatus into the vertical installation. As a consequence, the toner density is the same as that in the horizontal installation. On the other hand, according to the construction of the conventional 1.5-component developing unit disclosed in Japanese Patent Laid-Open Publication Number 3-252686, as indicated by a white circle in the Figure, when placed vertically, the toner density increases. The toner density changes with the result that the image density also varies depending on the horizontal installation and the vertical installation. This proves the above-stated action of stabilization of the toner supply. The image formation with no change in the image density can be thereby attained even when the apparatus is placed horizontally or when placed vertically. It is possible to actualize the image forming apparatus capable of being set both in the horizontal installation and in the vertical installation.

Figure 10:
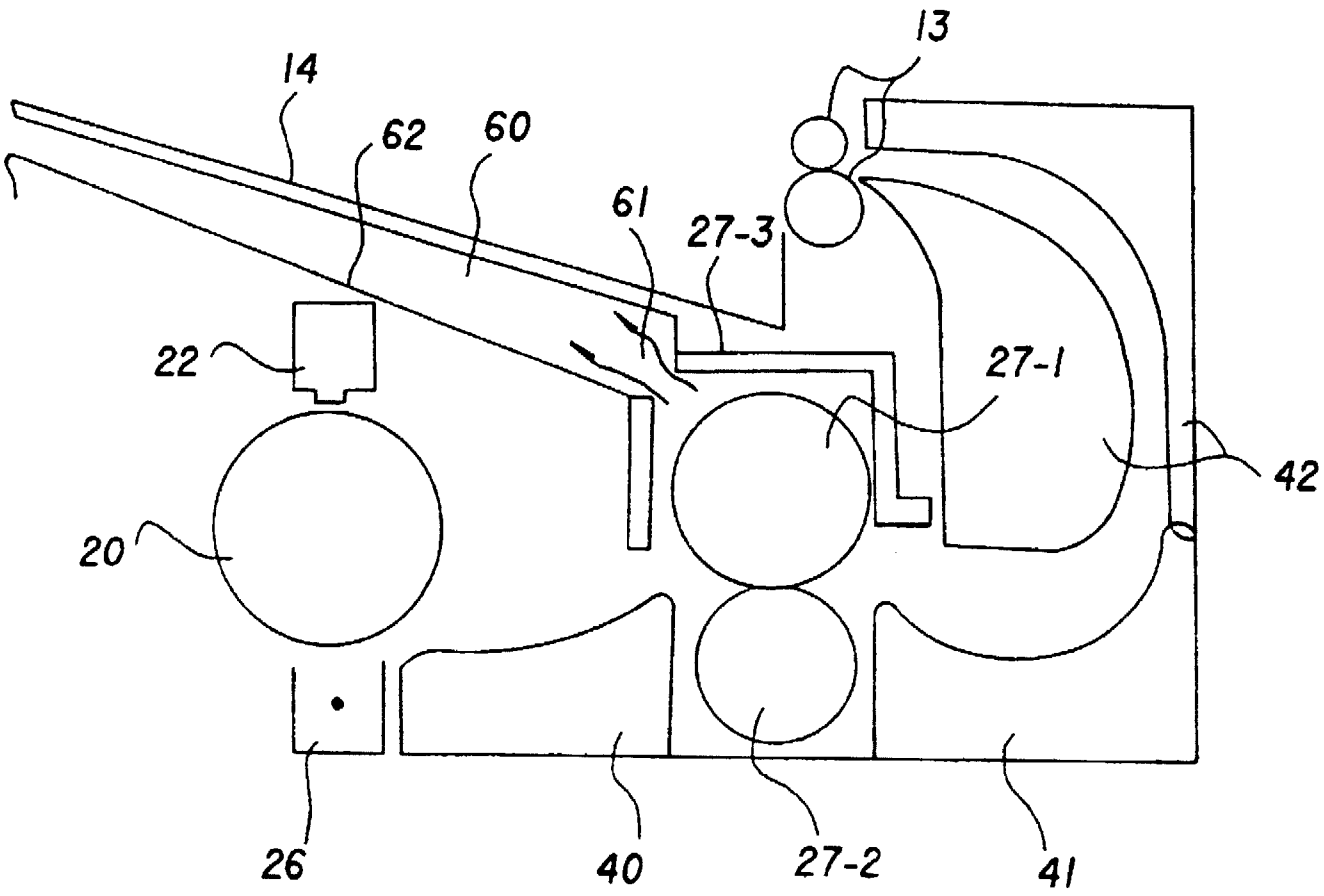
FIG. 10 is a view illustrating one embodiment of an exhaust duct according to this invention.
Figure 11:
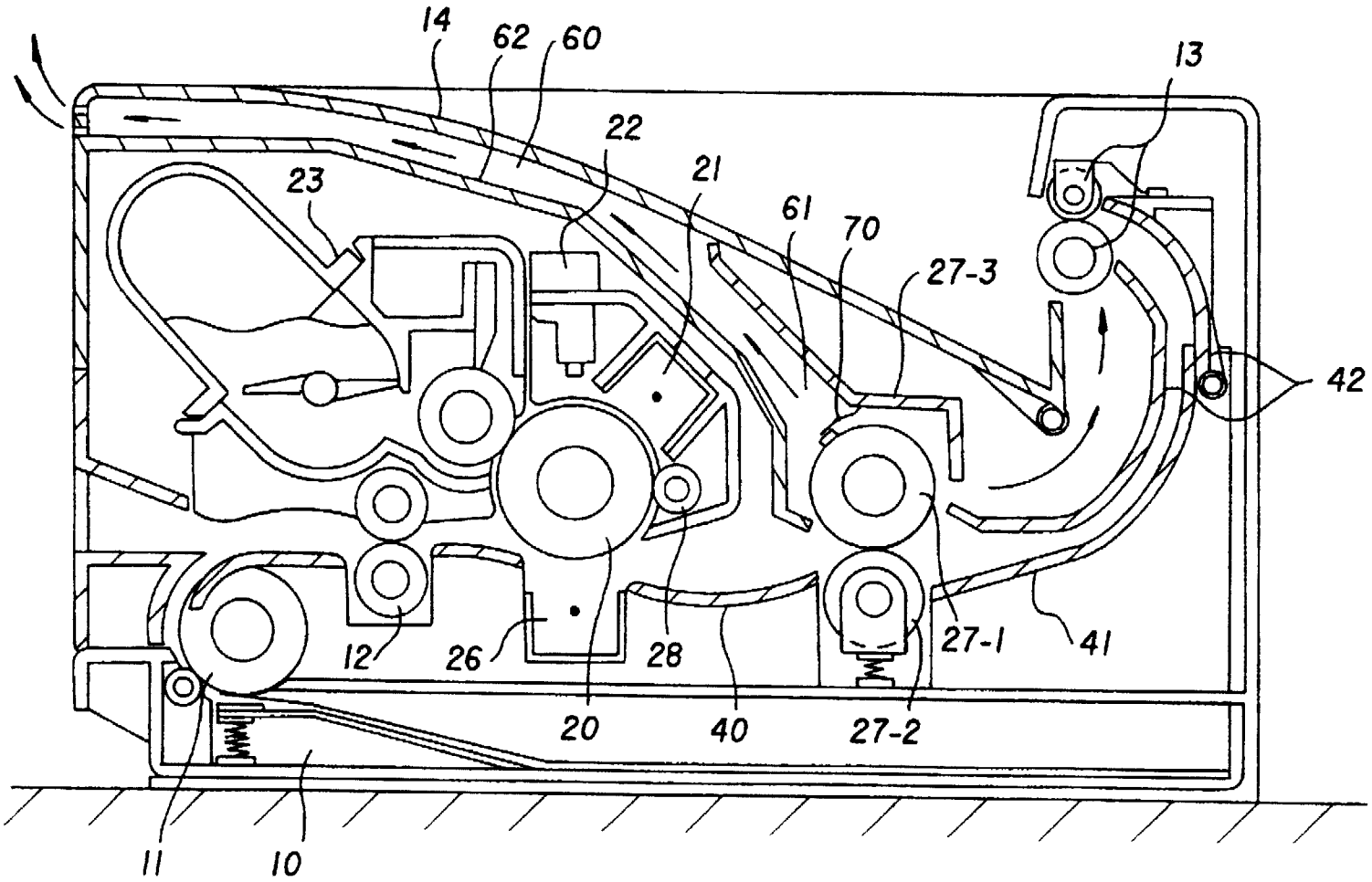
FIG. 11 is a view showing a state of the horizonal installation of the apparatus of FIG. 10.
Figure 12:
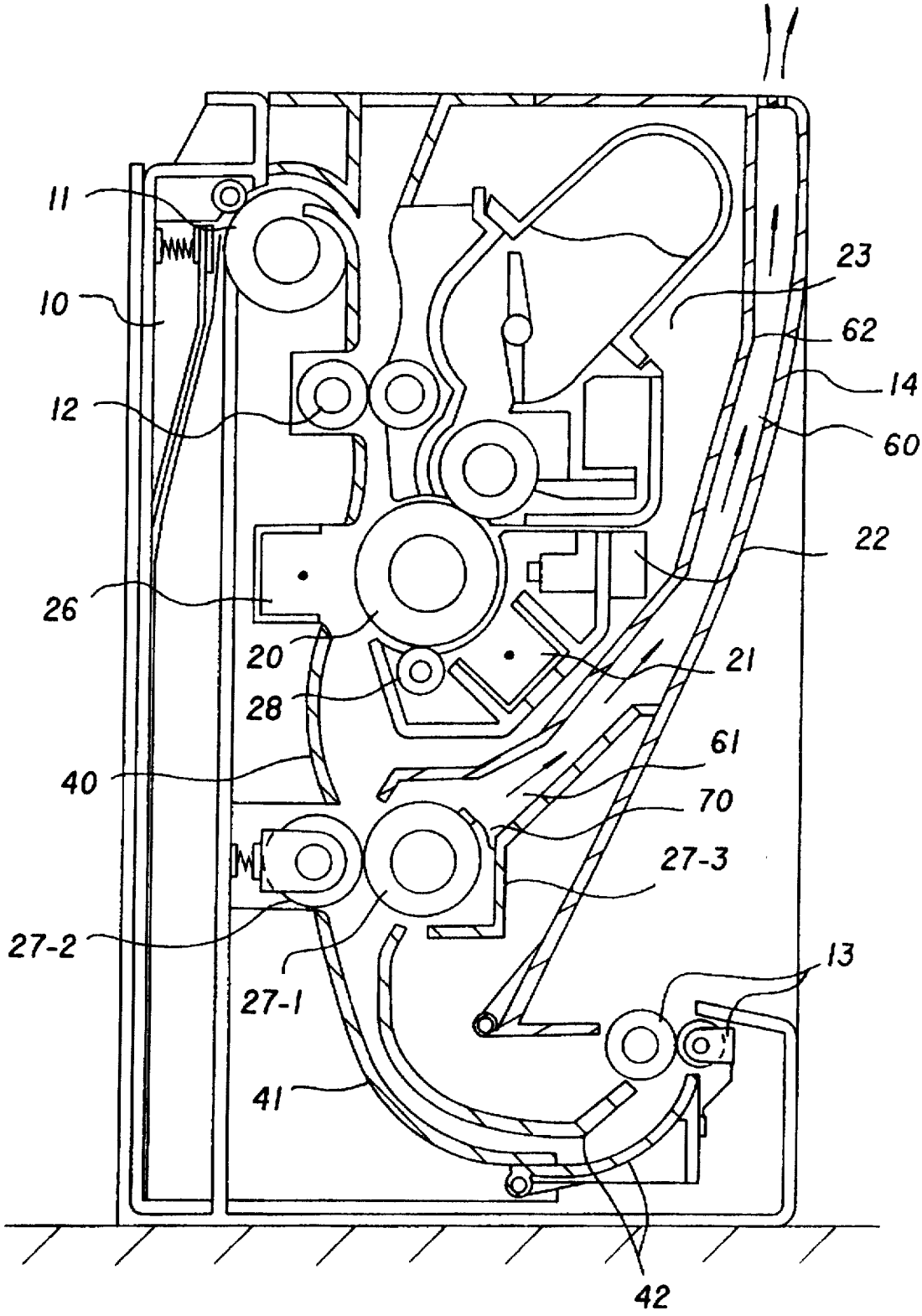
FIG. 12 is a view showing a state of the vertical installation of the apparatus of FIG. 10.

FIG. 10 is a view illustrating a configuration of the exhaust duct in one embodiment of the present invention. FIG. 11 is a view showing a state of the horizontal installation in FIG. 10. FIG. 12 is a view showing a state of the vertical installation in FIG. 10.

Referring to FIGS. 10 through 12, the same elements as those shown in FIG. 2 are marked with the like symbols. As illustrated in FIG. 10, the air outlet 61 is formed in the direction inclined to the frame 27-3 of the thermal fixing unit 27. As shown in FIG. 1, it is desirable that an angle of the air outlet 61 with respect to the frame 27-3 be approximately 45 degrees. A passageway of the exhaust duct 60, which communicates with this air outlet 61 but extending in the oblique direction, is provided under the stacker 14. This exhaust duct 60 is partitioned from the photosensitive drum 20 by a partition wall 62. Note that the numerals 40, 41 designate sheet guides of the thermal fixing unit 27, while the numeral 42 represents a sheet guide.

As illustrated in FIG. 11, in the state of the horizontal installation of the apparatus, the ascending air flow from the thermal fixing unit 27 is led into the exhaust duct 60 via the air outlet 61 formed at the frame 27-3 and exhausted to the outside from the left-side surface of the apparatus. At this time, some heat and some water vapor of the thermal fixing unit 27 are exhausted with the aid of the discharge rollers 13. Note that the numeral 70 denotes a temperature detector, which will be mentioned later, for detecting a temperature of the heat roller 27-1.

As depicted in FIG. 12, in the vertical installation state of the apparatus, the thermal fixing elements 27-1, 27-2 are positioned under the photosensitive drum 20. With this arrangement, the ascending air flow from the thermal fixing unit 27 runs toward the photosensitive drum 20. However, the air outlet 61 is provided in the direction oblique to the frame 27-3, and, therefore, the ascending air flow of the thermal fixing unit 27 is led into the exhaust duct 60 from the air outlet 61 of the frame 27-3. Then, the air flow is exhausted to the outside from the upper surface of the apparatus.

In this manner, the air outlet 61 is formed in the direction oblique to the frame 27-3, and the passageway of the exhaust duct 60 is obliquely directed. Hence, in the horizontal and vertical installation states of the apparatus, the air flow of the heat or the like of the thermal fixing unit 27 can be prevented from running toward the photosensitive drum 20. Thus, it is feasible to prevent the photosensitive drum 20 from being deteriorated due to the heat or the like of the thermal fixing unit 27.

Further, the exhaust duct 60 is tilted, and hence the air flow from the thermal fixing unit 27 is easy to run both in the horizontal installation and in the vertical installation. The air flow is also prevented from running toward the photosensitive drum. Moreover, the exhaust duct 60 is partitioned therefrom, and it is therefore possible to prevent a diffusion of the heat or the like of the thermal fixing unit 27 into the interior of the apparatus.

Figure 13:
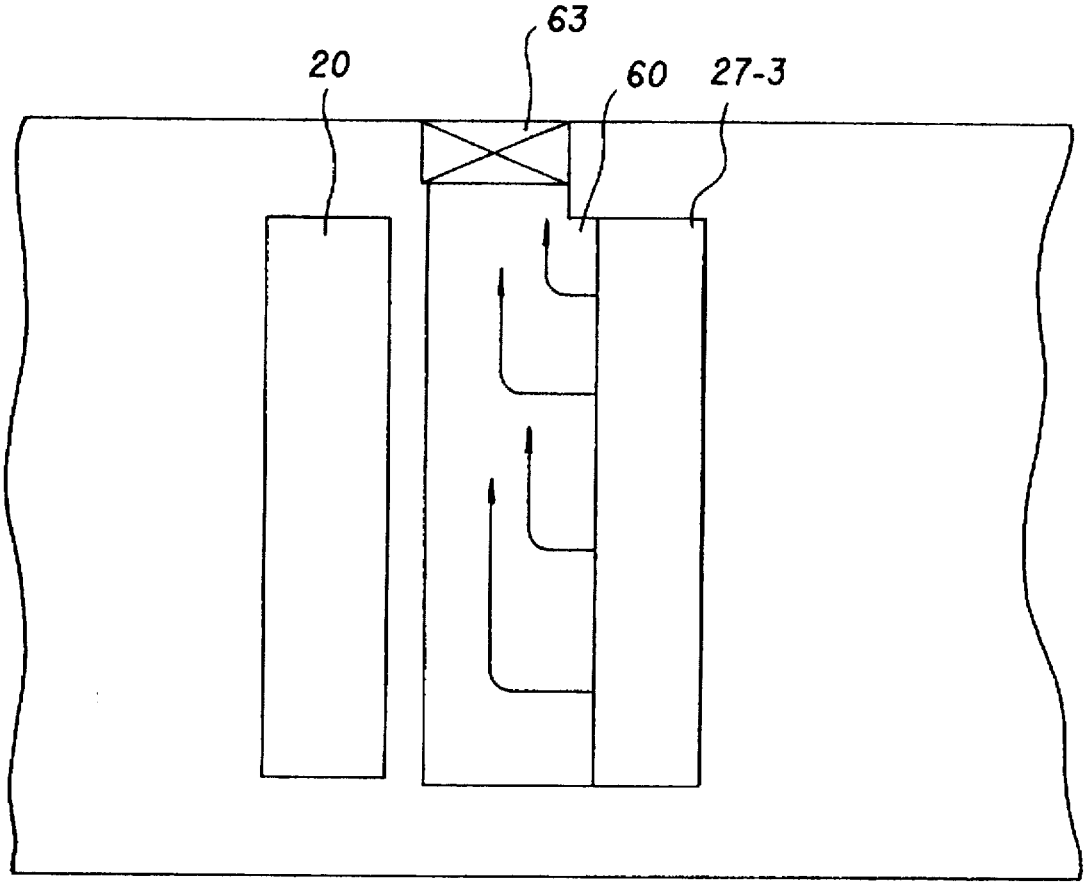
FIG. 13 is a top view illustrating a modified example of the exhaust duct of the present invention.
Figure 14:
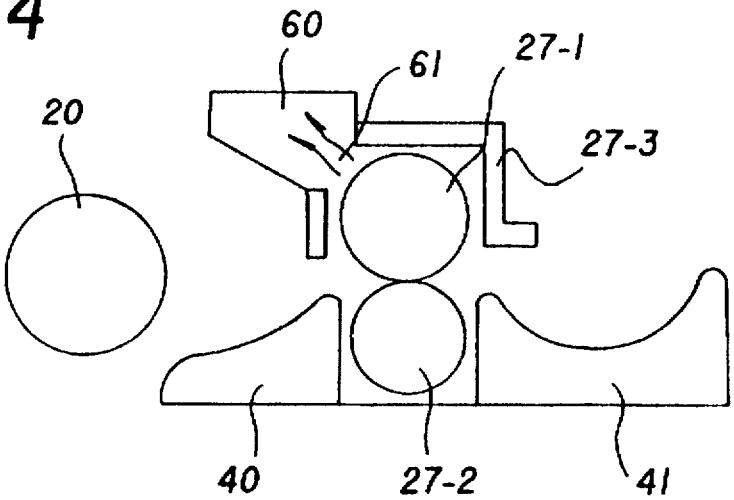
FIG. 14 is a sectional view of the construction of FIG. 13.

FIG. 13 is a top view illustrating a modified example of the exhaust duct according to the present invention. FIG. 14 is a side view of the exhaust duct of FIG. 13.

Referring to FIGS. 13 and 14, the same elements as those shown in FIGS. 10 to 12 are marked with the like symbols. As shown in FIG. 14, there is provided the exhaust duct 60 extending from the air outlet 61 formed obliquely to the frame 27-3. This exhaust duct 60, as illustrated in FIG. 13, communicates with an exhaust fan 63 mounted in the sidle surface of the apparatus.

With the arrangement taken in this way, the heat or the like of the thermal fixing unit 27 is let out of the air outlet 61 of the frame 27-3 and runs via the passageway of the exhaust duct 60. The heat thereof is then exhausted from the side surface of the apparatus by the exhaust fan 63.

As a result, the air flow of the heat or the like of the thermal fixing unit 27 can be prevented from running toward the photosensitive drum 20 when the apparatus is installed horizontally and vertically. Thus, it is possible to prevent the photosensitive drum 20 from being deteriorated due to the heat or the like of the thermal fixing unit 27. Further, in accordance with this embodiment, down-sizing of the exhaust duct 60 can be attained.

Figure 15:
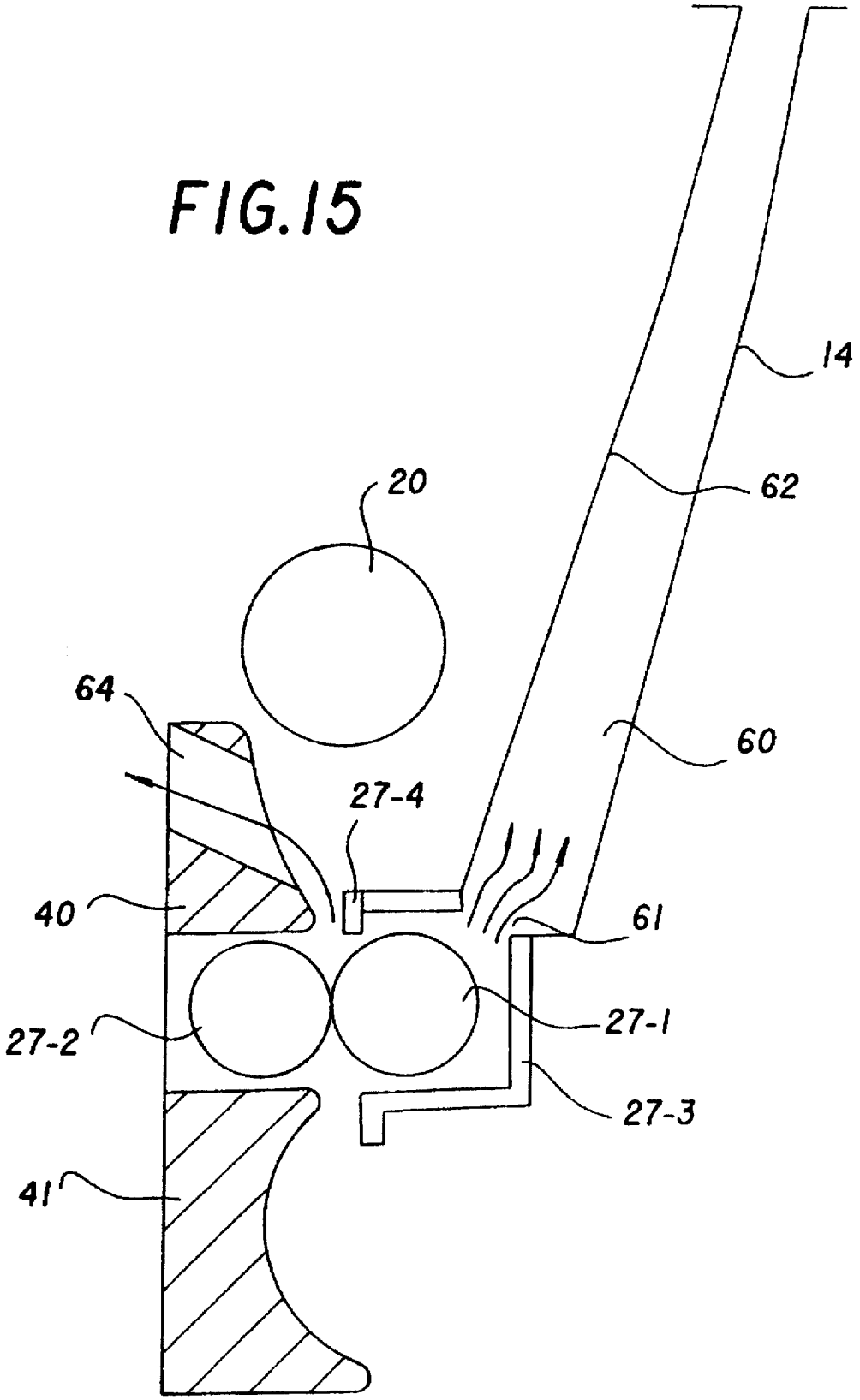
FIG. 15 is a sectional view showing another modified example of the exhaust duct of the present invention.

FIG. 15 is a side view of the exhaust duct but shows a modified example thereof according to the present invention. FIG. 15 illustrates a state of the vertical installation.

As depicted in FIG. 15, in the vertical installation state, the photosensitive drum 20 is located more upstream than the thermal fixing unit 27. Therefore, even when the air outlet 61 and the exhaust duct 60 are provided in the direction oblique to the frame 27-3, there exists a possibility in which the heat or the like of the thermal fixing unit 27 flows toward the photosensitive drum 20 from between the sheet guide 40 and the frame 27-3.

Preventing this outflow involves, first, providing a second exhaust duct 64 in the sheet guide 40 between the photosensitive drum 20 and the thermal fixing unit 27. This arrangement permits an escape of the heat which is to flow toward the photosensitive drum 20 but prevents the outflow thereof toward the photosensitive drum 20.

Second, a stopper 27-4 is provided on the side of the sheet guide 40 of the frame 27-3. With this provision, the heat or the like in the frame 27-3 is prevented from running toward the photosensitive drum 20 from between the sheet guide 40 and the frame 27-3. This arrangement makes it possible to prevent the air flow of the heat or the like of the thermal fixing unit 27 from running toward the photosensitive drum 20 more certainly when the apparatus is installed horizontally and vertically. This further prevents the deterioration of the photosensitive drum 20 due to the heat or the like of the thermal fixing unit 27.

Figure 17:
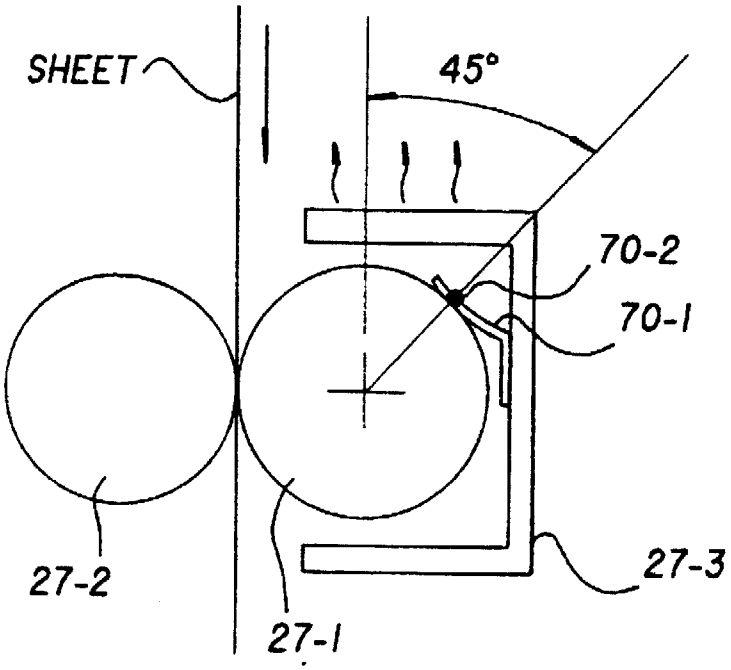
FIG. 17 is a view showing a state of the vertical installation in accordance with the construction of FIG. 16.
Figure 16:
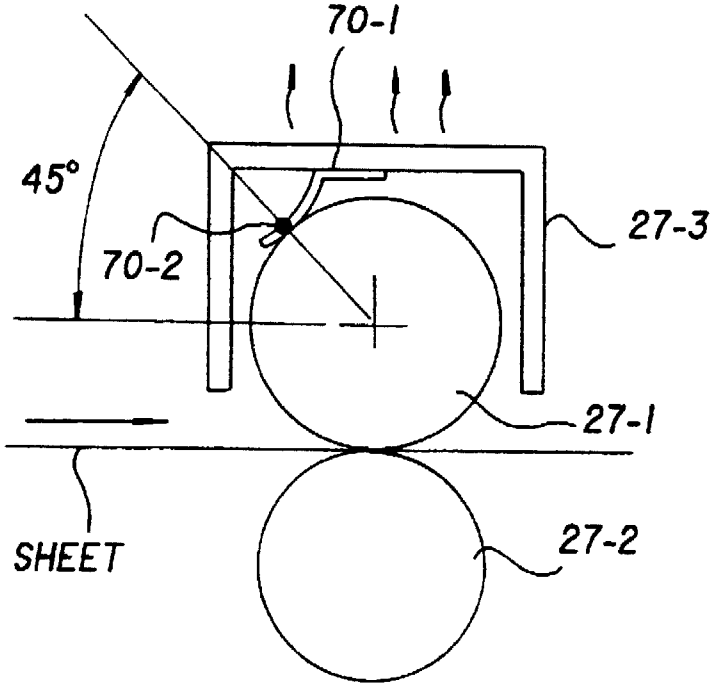
FIG. 16 is a view showing an example of placement of a temperature detector of this invention.

FIGS. 16 and 17 are explanatory views of one embodiment of the temperature detector according to the present invention. FIG. 16 illustrates the thermal fixing unit in the horizontal installation state. FIG. 17 shows the thermal fixing unit in the vertical installation state.

As illustrated in FIG. 16, in the horizontal installation state of the apparatus, the ascending air flow (thermal air flow) of the thermal fixing unit 27 is directed upward from the upper surface of the frame 27-3. On the other hand, as shown in FIG. 17, in the vertical installation state of the; apparatus, the ascending air flow (thermal air flow) of the thermal fixing unit 27 is directed sideways from the side surface of the frame 27-3. In this way, the direction of the air flow of the thermal fixing unit 27 differs depending on the direction in which the apparatus is installed.

On the other hand, it is required that a fixing temperature be controlled at a fixed temperature by detecting a temperature of the heat roller 27-1 and controlling a thermal source of the heat roller 27-1. For this purpose, there is provided a temperature detector 70 for detecting the temperature of the heat roller 27-1. However, an ambient temperature differs corresponding to the direction of the air flow, depending on the horizontal installation and the vertical installation, with the result that an error in terms of the detected temperature is easy to occur.

Therefore, as shown in FIG. 16, a temperature sensor 70-2 is installed in an oblique direction of the heat roller 27-1. That is, the temperature sensor 70-2 provided at the tip of a leaf spring 70-1 is pressed in an oblique position of the heat roller 27-1. This oblique position is set adequately at about 45 degrees with resect to the horizontal direction. Further, a thermistor is suited to the temperature sensor 70-2.

With this construction, even in the case of the horizontal installation shown in FIG. 16, or even in the case of the vertical installation shown in FIG. 17, the same influence of the air flow is exerted on the temperature sensor 70-2. For this reason, the temperature can be accurately detected even when the apparatus is installed horizontally or vertically. Further, this can be attained simply by shifting the position of the temperature sensor 70-2.

Figure 19:
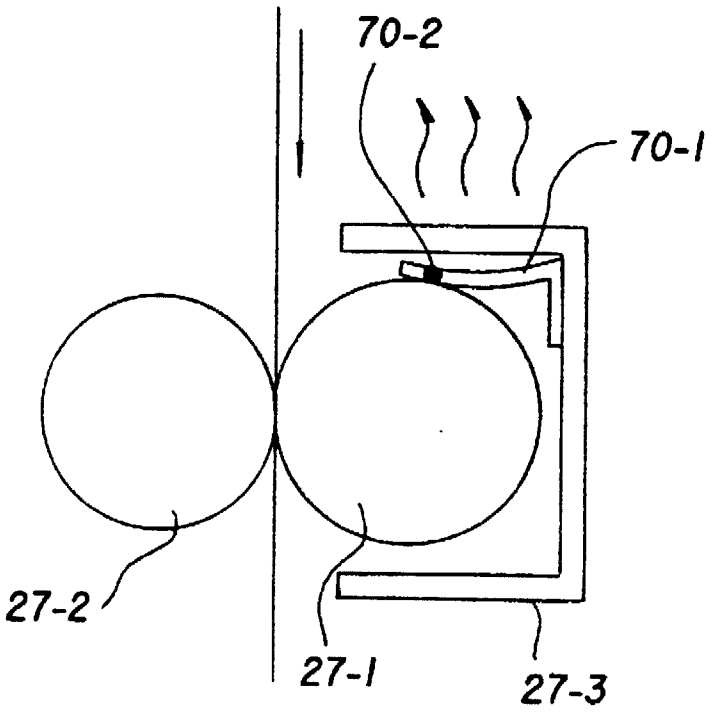
FIG. 19 is a view showing a state of the vertical installation in accordance with the construction of FIG. 18.
Figure 18:
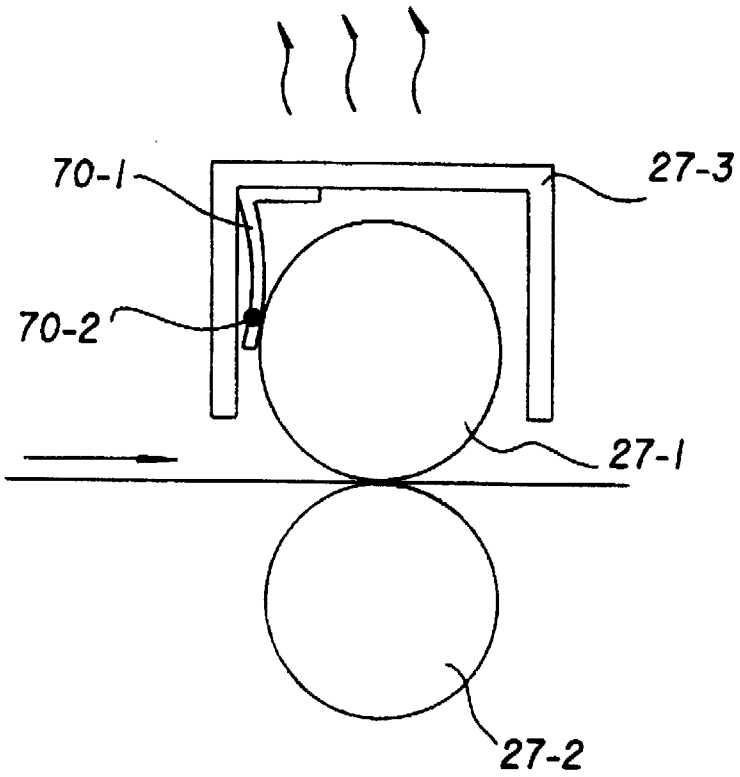
FIG. 18 is a view showing another example of placement of the temperature detector of this invention.
Figure 20:
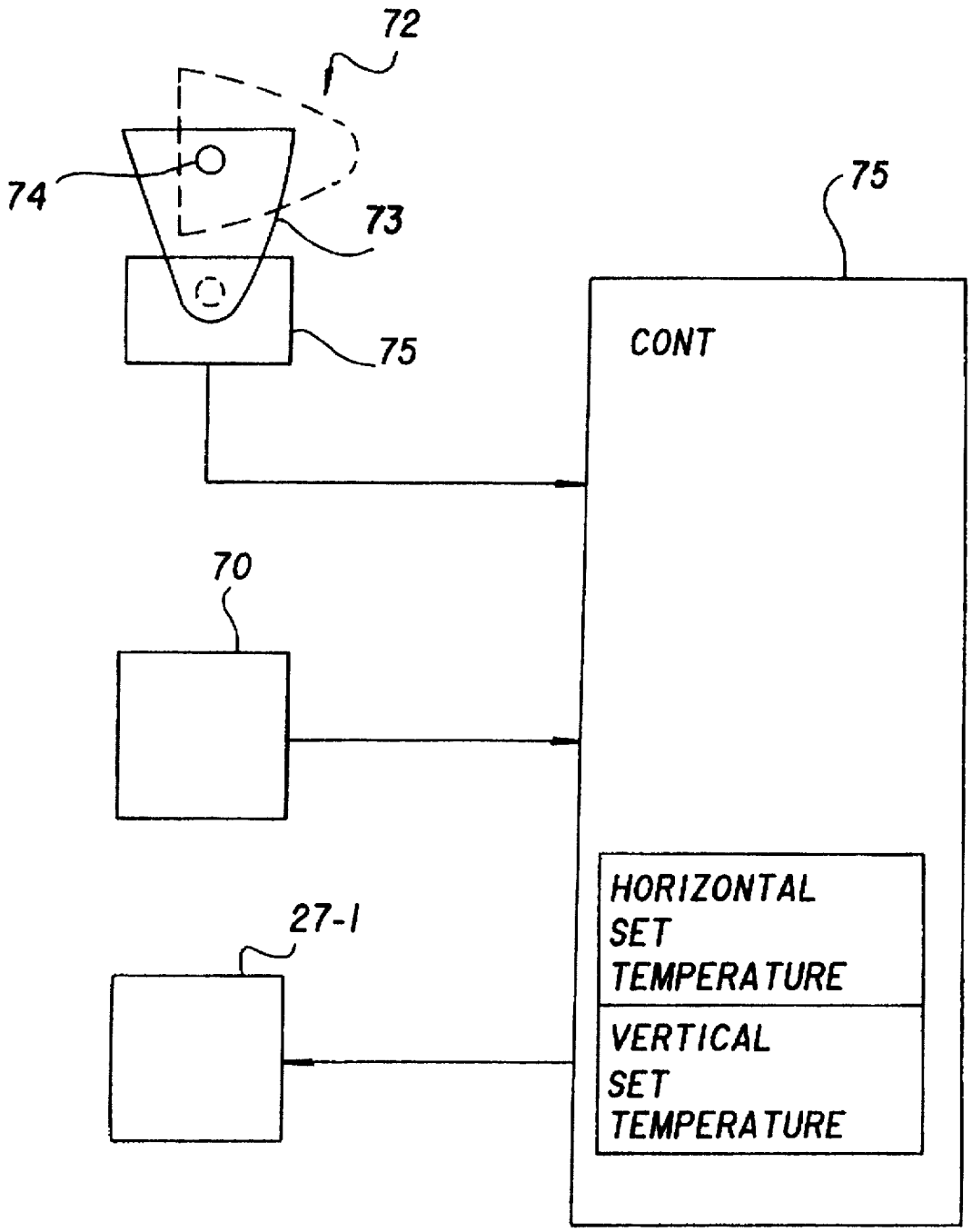
FIG. 20 is a block diagram showing the control relative to the construction of FIG. 18.

FIGS. 18 and 19 are views showing modified examples of the temperature detector according to this invention. FIG 20 is a block diagram of an embodiment of FIG. 19. Note that FIG. 18 illustrates the thermal fixing unit in the horizontal installation state. FIG. 19 shows the thermal fixing unit in the vertical installation state.

As discussed above, in the horizontal installation state of the apparatus, the ascending air flow (thermal air flow) of the thermal fixing unit 27 is directed upward from the upper surface of the frame 27-3. In the vertical installation state of the apparatus, the ascending air flow (thermal air flow) of the thermal fixing unit 27 is directed sideways from the side surface of the frame 27-3. In this way, the direction of the air flow of the thermal fixing unit 27 differs depending on the direction where the apparatus is installed. For this reason, the ambient temperature differs corresponding to the direction of the air flow, and the error in terms of the detected temperature is easy to occur.

As illustrated in FIGS. 18 and 19, the temperature sensor 70-2 of the temperature detector 70 is installed in a side-surface position of the heat roller 27-1. Namely, the temperature 70-2 provided at the tip of the leaf spring 70-1 is pressed in the side-surface position of the heat roller 27-1. Consequently, in the horizontal installation state of FIG. 18, the detected temperature is relatively low. Whereas in the vertical installation state of FIG. 19, the detected temperature is relatively high. A difference between the detected temperatures due to variations in this air flow is corrected by a control element.

That is, as shown in FIG. 20, an apparatus 1 incorporates a detector 72 for detecting an installing direction of the apparatus. This installing direction detector 72 includes a fixed transmission type photosensor 75 and a pendulum 73 rotating about the center of a rotary shaft 74. Hence, in the horizontal installation state, the pendulum 73 is positioned as indicated by a solid line in FIG. 20 and thus intercepts an optical path of the transmission type photosensor 75. On the other hand, in the vertical installation state, the pendulum 73 rotates to a position indicated by a dotted line in FIG. 20 but does not intercept the optical path of the transmission type photosensor 75. Thus, the installing direction of the apparatus can be detected.

On the other hand, there is provided a control circuit 76 for receiving an output of the temperature sensor 70 and controlling the temperature of the thermal source of the heat roller 27-1. This control circuit 76 stores a set temperature for the horizontal installation and a set temperature for the vertical installation.

The control circuit 76, on receiving a detected output of the installing direction detector 72, discriminates the installing direction of the apparatus. Based on a result of this determination, the control circuit 76 determines whether the temperature is set at the horizontal set temperature or the vertical set temperature. Then, the control circuit 76 compares a temperature detected by the temperature detector with the thus determined set temperature. The control circuit 76 controls the temperature of the thermal source of the heat roller 27-1 in accordance with the comparative result therebetween.

In this way, when the apparatus is installed horizontally, the control is conducted at a relatively low horizontal set temperature. When installed vertically, the control is performed at a relatively high vertical set temperature. Consequently, the detected temperature becomes low in the horizontal installation state but high in the vertical installation state. Even if a difference between the detected temperatures is thus caused, the difference can be controlled by correcting it with the control element.

Figure 22:
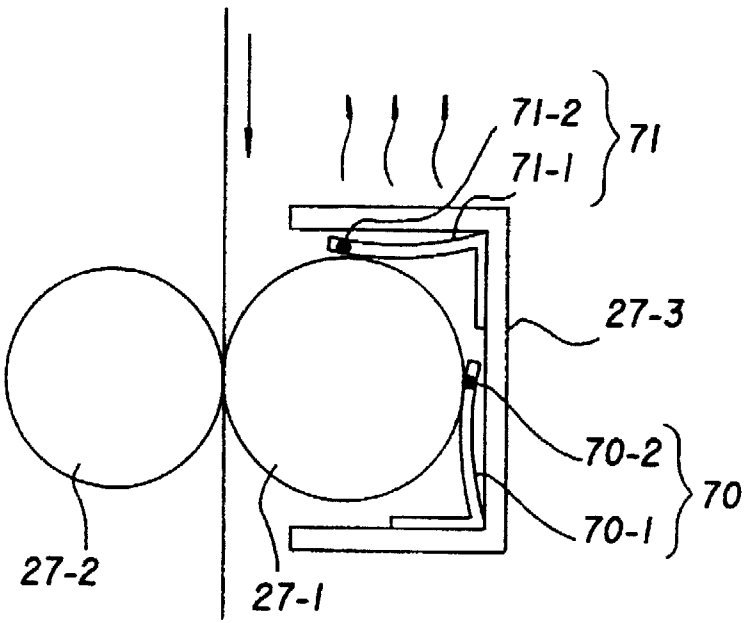
FIG. 22 is a view showing a state of the vertical installation in accordance with the construction of FIG. 21.
Figure 21:
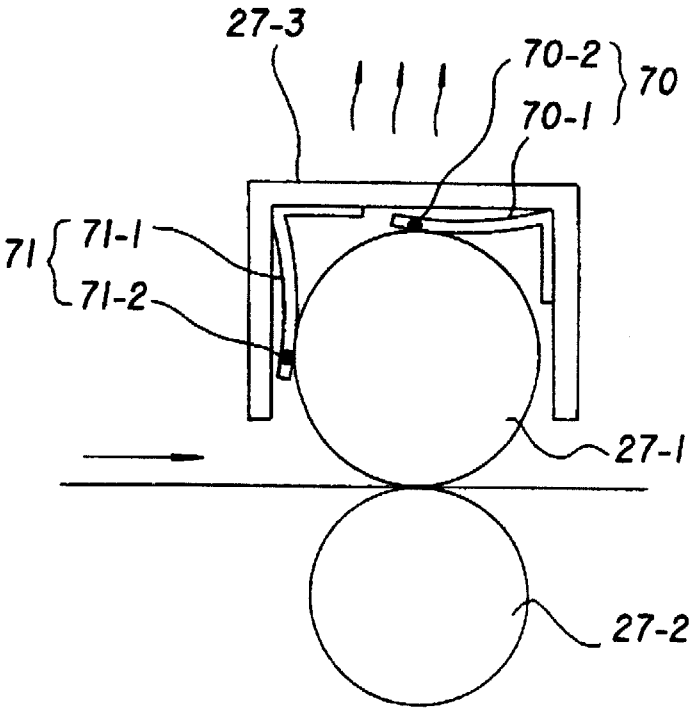
FIG. 21 is a view showing still another example of placement of the temperature detector of this invention.
Figure 23:
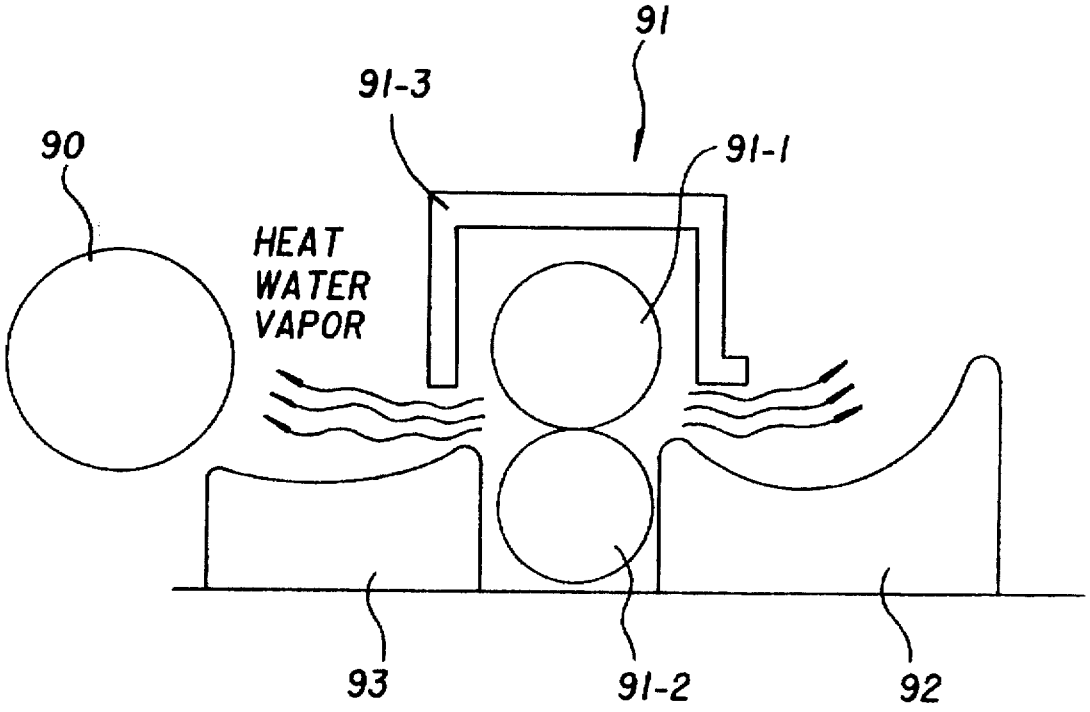
FIG. 23 is an explanatory view of the prior art.

FIGS. 21 and 22 are explanatory views of other modified examples of the temperature detector according to this invention. FIG. 21 illustrates the thermal fixing unit in the horizontal installation state. FIG. 22 shows the thermal fixing unit in the vertical installation state.

As explained earlier, the direction of the air flow of the thermal fixing unit 27 differs depending on the installing direction of the apparatus. The ambient temperature therefore differs corresponding to the direction of the air flow, depending on the horizontal installation and the vertical installation. The error in terms of the detected temperature is consequently easy to occur.

Under such circumstances, as illustrated in FIG. 21, a couple of temperature detectors 70, 71 are provided in directions different from each other with respect to the heat roller. 27-1. That is, a temperature sensor 70-2 provided at the tip of a leaf spring 70-1 is pressed in an upper-surface position of the heat roller 27-1. On the other hand, a temperature sensor 71-2 provided at the tip of a leaf spring 71-1 is pressed in a side-surface position of the heat roller 27-1.

Then, in the horizontal installation shown in FIG. 21, an output of the temperature sensor 70-2 (or the temperature sensor 70-1) is employed. On the other hand, in the vertical installation shown in FIG. 22, there is used an output of the temperature sensor 71-1 (or the temperature sensor 71-2).

If done in this manner, even in the case of the horizontal installation shown in FIG. 21 or the vertical installation shown in FIG. 22, the same influence of the air flow is exerted on the temperature sensor for detecting the temperature. Therefore, the temperature is accurately detectable even when the apparatus is placed horizontally or vertically.

Further, another method involves the use of outputs of the temperature sensors 70-2, 71-2 both in the horizontal installation state shown in FIG. 21 and in the vertical installation state shown in FIG. 22. Then, this average value of both outputs is employed as a detected temperature. Namely, the temperature control is done based on the average value. When controlled in this way, the same action and effect are exhibited. In this case, each of the two temperature sensors 70-2, 71-2 is constructed of a thermistor, the two thermistors are connected in series, whereby an average value may be thus obtained. Further, the two thermistors are connected in parallel, and an average value can be also obtained.

The following are possible modifications of the present invention other than the above-mentioned embodiment. First, the image exposing unit involves the use of the LED optical system but may involve the use of a laser optical system, a liquid crystal shutter optical system, an EL (Electroluminescence) optical system, etc.. Second, the latent image forming mechanism has been explained in the form of the electrophotographic mechanism but may be usable for a latent image forming mechanism for transferring the toner image on the photosensitive drum.

Third, the sheet is not confined to the paper but may include the use of other mediums. Further, the photosensitive drum is not limited to the drum-like shape but may be formed in a belt-like configuration. Fourth, the image forming apparatus has been described in the form of the printer but may be other image forming apparatuses such as a copying machine, a facsimile, etc..

The present invention has been discussed so far by way of the embodiments but may be effected in a variety of modifications within the scope of the gist of the present invention, and these modifications are not excluded from the scope of the present invention.

As discussed above, according to the present invention, there is provided the exhaust duct for guiding the air flow of the thermal fixing unit in the oblique direction. Hence, even when installed horizontally or vertically, the heat and the water vapor of the thermal fixing unit can be prevented from running toward the photosensitive drum. It is possible to prevent a decline in terms of a printing quality as well as the deterioration of the photo sensitive drum. Further, the temperature is detected in consideration of the direction of the air flow of the thermal fixing unit, and, therefore, the fixing temperature can be kept at a fixed temperature even when installed horizontally or vertically.

What is claimed is:

1. An image forming apparatus for forming a toner image on a sheet both in a horizontal installation and in a vertical installation of said apparatus, comprising:

an image forming unit forming the toner image on a rotary photosensitive body assuming an endless-shape and then transferring the toner image onto the sheet;

a thermal fixing unit, having a heat roller and positioned under said image forming unit when installed vertically, for thermally fixing the toner image on the sheet fed from above;

a plurality of temperature detectors, each provided in a different position along a circumferential direction of said heat roller of said thermal fixing unit, for detecting a temperature of said thermal fixing unit; and a control circuit for controlling a fixing temperature of said heat roller in both said horizontal installation and said vertical installation of said apparatus, by using outputs of said temperature detectors.

2. The image forming apparatus according to claim 1, wherein said image forming unit comprises:

said photosensitive body;

a charger for charging said photosensitive body;

an exposing unit for exposing an image on said charged photosensitive body;

a developing unit for effecting a development on said image-exposed photosensitive body and thus forming a toner image on said photosensitive body; and a transfer unit for transferring the toner image on said photosensitive body onto the sheet.

3. An image forming apparatus for forming a toner image on a sheet both in a horizonal installation and in a vertical installation of said apparatus, comprising:

an image forming unit for forming the toner image on a rotary photosensitive body assuming an endless-shape and then transferring the toner image onto the sheet;

a thermal fixing unit, having a heat roller and positioned under said image forming unit when installed vertically, for thermally fixing the toner image on the sheet fed from above;

a temperature detector for detecting a temperature of said heat roller of said thermal fixing unit; and a control circuit for controlling a fixing temperature of said heat roller, by comparing a set temperature corresponding to an installing direction of said apparatus with a temperature detected by said temperature detector.

4. The image forming apparatus according to claim 3, wherein said image forming unit comprises:

said photosensitive body;

a charger for charging said photosensitive body;

an exposing unit for exposing an image on said charged photosensitive body;

a developing unit for effecting a development on said image-exposed photosensitive body and thus forming a toner image on said photosensitive body; and a transfer unit for transferring the toner image on said photosensitive body onto the sheet.

5. An image forming apparatus for forming a toner image on a sheet both in a horizontal installation and in a vertical installation of said apparatus, comprising:

an image forming unit for forming the toner image on a rotary photosensitive body assuming an endless-shape and then transferring the toner image onto the sheet;

a thermal fixing unit, having a heat roller and positioned under said image forming unit when installed vertically, for thermally fixing the toner image on the sheet fed from above;

a plurality of temperature detectors, each provided in a different position with respect to said heat roller of said thermal fixing unit, for detecting a temperature of said thermal fixing unit; and a control circuit for controlling a fixing temperature of said heat roller, by selecting one output from the outputs of said temperature detectors corresponding to an installing direction of said apparatus.

6. An image forming apparatus for forming a toner image on a sheet both in a horizontal installation and in a vertical installation of said apparatus, comprising:

an image forming unit for forming the toner image on a rotary photosensitive body assuming an endless-shape and then transferring the toner image onto the sheet;

a thermal fixing unit, having a heat roller and positioned under said image forming unit when installed vertically, for thermally fixing the toner image on the sheet fed from above;

a plurality of temperature detectors, each provided in a different position with respect to said heat roller of said thermal fixing unit, for detecting a temperature of said thermal fixing unit; and a control circuit for controlling a fixing temperature of said heat roller, by using an average temperature of outputs of temperature detectors.

* * * * *